US007565815B2

(12) United States Patent
Wilkinson et al.

(10) Patent No.: US 7,565,815 B2
(45) Date of Patent: Jul. 28, 2009

(54) NATURAL GAS LIQUEFACTION

(75) Inventors: John D. Wilkinson, Midland, TX (US); Hank M. Hudson, Midland, TX (US); Kyle T. Cuellar, Katy, TX (US)

(73) Assignee: Ortloff Engineers, Ltd., Midland, TX (US)

( * ) Notice: Subject to any disclaimer, the term of this patent is extended or adjusted under 35 U.S.C. 154(b) by 185 days.

(21) Appl. No.: 11/707,787

(22) Filed: Feb. 16, 2007

(65) Prior Publication Data

US 2008/0028790 A1 Feb. 7, 2008

Related U.S. Application Data

(62) Division of application No. 11/188,297, filed on Jul. 22, 2005, now Pat. No. 7,210,311, and a division of application No. 10/823,248, filed on Apr. 13, 2004, now Pat. No. 7,010,937, and a division of application No. 10/161,780, filed on Jun. 4, 2002, now Pat. No. 6,742,358.

(60) Provisional application No. 60/296,848, filed on Jun. 8, 2001.

(51) Int. Cl.
*F25J 1/00* (2006.01)
*F25J 3/00* (2006.01)

(52) U.S. Cl. ..... 62/613; 62/620; 62/625; 62/631

(58) Field of Classification Search ..... 62/613, 62/620, 621, 625, 630, 631
See application file for complete search history.

(56) References Cited

U.S. PATENT DOCUMENTS 4,895,584 A * 1/1990 Buck et al. ..... 62/621
5,685,170 A * 11/1997 Sorensen ..... 62/625
6,526,777 B1 * 3/2003 Campbell et al. ..... 62/621

* cited by examiner

*Primary Examiner*—William C Doerrler
(74) *Attorney, Agent, or Firm*—Fitzpatrick, Cella, Harper & Scinto

(57) ABSTRACT

A process for liquefying natural gas in conjunction with producing a liquid stream containing predominantly hydrocarbons heavier than methane is disclosed. In the process, the natural gas stream to be liquefied is partially cooled, expanded to an intermediate pressure, and supplied to a distillation column. The bottom product from this distillation column preferentially contains the majority of any hydrocarbons heavier than methane that would otherwise reduce the purity of the liquefied natural gas. The residual gas stream from the distillation column is compressed to a higher intermediate pressure, cooled under pressure to condense it, and then expanded to low pressure to form the liquefied natural gas stream.

12 Claims, 21 Drawing Sheets

NATURAL GAS LIQUEFACTION

CROSS REFERENCE TO RELATED APPLICATIONS

This is a divisional of U.S. patent application Ser. No. 11/188,297, filed Jul. 22, 2005. This is a divisional of U.S. patent application Ser. No. 10/823,248, filed on Apr. 13, 2004 which is a divisional of U.S. patent application Ser. No. 10/161,780, filed on Jun. 4, 2002, which claims priority under 35 U.S.C. § 199(e) to U.S. Provisional Patent Application No. 60/296,848, filed on Jun. 8, 2001.

BACKGROUND OF THE INVENTION

This invention relates to a process for processing natural gas or other methane-rich gas streams to produce a liquefied natural gas (LNG) stream that has a high methane purity and a liquid stream containing predominantly hydrocarbons heavier than methane. The applicants claim the benefits under Title 35, United States Code, Section 119(e) of prior U.S. provisional application Ser. No. 60/296,848 which was filed on Jun. 8, 2001.

Natural gas is typically recovered from wells drilled into underground reservoirs. It usually has a major proportion of methane, i.e., methane comprises at least 50 mole percent of the gas. Depending on the particular underground reservoir, the natural gas also contains relatively lesser amounts of heavier hydrocarbons such as ethane, propane, butanes, pentanes and the like, as well as water, hydrogen, nitrogen, carbon dioxide, and other gases.

Most natural gas is handled in gaseous form. The most common means for transporting natural gas from the wellhead to gas processing plants and thence to the natural gas consumers is in high pressure gas transmission pipelines. In a number of circumstances, however, it has been found necessary and/or desirable to liquefy the natural gas either for transport or for use. In remote locations, for instance, there is often no pipeline infrastructure that would allow for convenient transportation of the natural gas to market. In such cases, the much lower specific volume of LNG relative to natural gas in the gaseous state can greatly reduce transportation costs by allowing delivery of the LNG using cargo ships and transport trucks.

Another circumstance that favors the liquefaction of natural gas is for its use as a motor vehicle fuel. In large metropolitan areas, there are fleets of buses, taxi cabs, and trucks that could be powered by LNG if there were an economic source of LNG available. Such LNG-fueled vehicles produce considerably less air pollution due to the clean-burning nature of natural gas when compared to similar vehicles powered by gasoline and diesel engines which combust higher molecular weight hydrocarbons. In addition, if the LNG is of high purity (i.e., with a methane purity of 95 mole percent or higher), the amount of carbon dioxide (a "greenhouse gas") produced is considerably less due to the lower carbon:hydrogen ratio for methane compared to all other hydrocarbon fuels.

The present invention is generally concerned with the liquefaction of natural gas while producing as a co-product a liquid stream consisting primarily of hydrocarbons heavier than methane, such as natural gas liquids (NGL) composed of ethane, propane, butanes, and heavier hydrocarbon components, liquefied petroleum gas (LPG) composed of propane, butanes, and heavier hydrocarbon components, or condensate composed of butanes and heavier hydrocarbon components. Producing the co-product liquid stream has two important benefits: the LNG produced has a high methane purity, and the co-product liquid is a valuable product that may be used for many other purposes. A typical analysis of a natural gas stream to be processed in accordance with this invention would be, in approximate mole percent, 84.2% methane, 7.9% ethane and other $C_2$ components, 4.9% propane and other $C_3$ components, 1.0% iso-butane, 1.1% normal butane, 0.8% pentanes plus, with the balance made up of nitrogen and carbon dioxide. Sulfur containing gases are also sometimes present.

There are a number of methods known for liquefying natural gas. For instance, see Finn, Adrian J., Grant L. Johnson, and Terry R. Tomlinson, "LNG Technology for Offshore and Mid-Scale Plants", Proceedings of the Seventy-Ninth Annual Convention of the Gas Processors Association, pp. 429-450, Atlanta, Ga., Mar. 13-15, 2000 and Kikkawa, Yoshitsugi, Masaaki Ohishi, and Noriyoshi Nozawa, "Optimize the Power System of Baseload LNG Plant", Proceedings of the Eightieth Annual Convention of the Gas Processors Association, San Antonio, Tex., Mar. 12-14, 2001 for surveys of a number of such processes. U.S. Pat. Nos. 4,445,917; 4,525,185; 4,545,795; 4,755,200; 5,291,736; 5,363,655; 5,365,740; 5,600,969; 5,615,561; 5,651,269; 5,755,114; 5,893,274; 6,014,869; 6,062,041; 6,119,479; 6,125,653; 6,250,105 B1; 6,269,655 B1; 6,272,882 B1; 6,308,531 B1; 6,324,867 B1; and 6,347,532 B1 also describe relevant processes. These methods generally include steps in which the natural gas is purified (by removing water and troublesome compounds such as carbon dioxide and sulfur compounds), cooled, condensed, and expanded. Cooling and condensation of the natural gas can be accomplished in many different manners. "Cascade refrigeration" employs heat exchange of the natural gas with several refrigerants having successively lower boiling points, such as propane, ethane, and methane. As an alternative, this heat exchange can be accomplished using a single refrigerant by evaporating the refrigerant at several different pressure levels. "Multi-component refrigeration" employs heat exchange of the natural gas with one or more refrigerant fluids composed of several refrigerant components in lieu of multiple single-component refrigerants. Expansion of the natural gas can be accomplished both isenthalpically (using Joule-Thomson expansion, for instance) and isentropically (using a work-expansion turbine, for instance).

Regardless of the method used to liquefy the natural gas stream, it is common to require removal of a significant fraction of the hydrocarbons heavier than methane before the methane-rich stream is liquefied. The reasons for this hydrocarbon removal step are numerous, including the need to control the heating value of the LNG stream, and the value of these heavier hydrocarbon components as products in their own right. Unfortunately, little attention has been focused heretofore on the efficiency of the hydrocarbon removal step.

In accordance with the present invention, it has been found that careful integration of the hydrocarbon removal step into the LNG liquefaction process can produce both LNG and a separate heavier hydrocarbon liquid product using significantly less energy than prior art processes. The present invention, although applicable at lower pressures, is particularly advantageous when processing feed gases in the range of 400 to 1500 psia [2,758 to 10,342 kPa(a)] or higher.

For a better understanding of the present invention, reference is made to the following examples and drawings. Referring to the drawings.

In the following explanation of the above figures, tables are provided summarizing flow rates calculated for representative process conditions. In the tables appearing herein, the values for flow rates (in moles per hour) have been rounded to the nearest whole number for convenience. The total stream rates shown in the tables include all non-hydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

For convenience, process parameters are reported in both the traditional British units and in the units of the International System of Units (SI). The molar flow rates given in the tables may be interpreted as either pound moles per hour or kilogram moles per hour. The energy consumptions reported as horsepower (HP) and/or thousand British Thermal Units per hour (MBTU/Hr) correspond to the stated molar flow rates in pound moles per hour. The energy consumptions reported as kilowatts (kW) correspond to the stated molar flow rates in kilogram moles per hour. The production rates reported as pounds per hour (Lb/Hr) correspond to the stated molar flow rates in pound moles per hour. The production rates reported as kilograms per hour (kg/Hr) correspond to the stated molar flow rates in kilogram moles per hour.

DESCRIPTION OF THE INVENTION

Example 1

Figure 1:
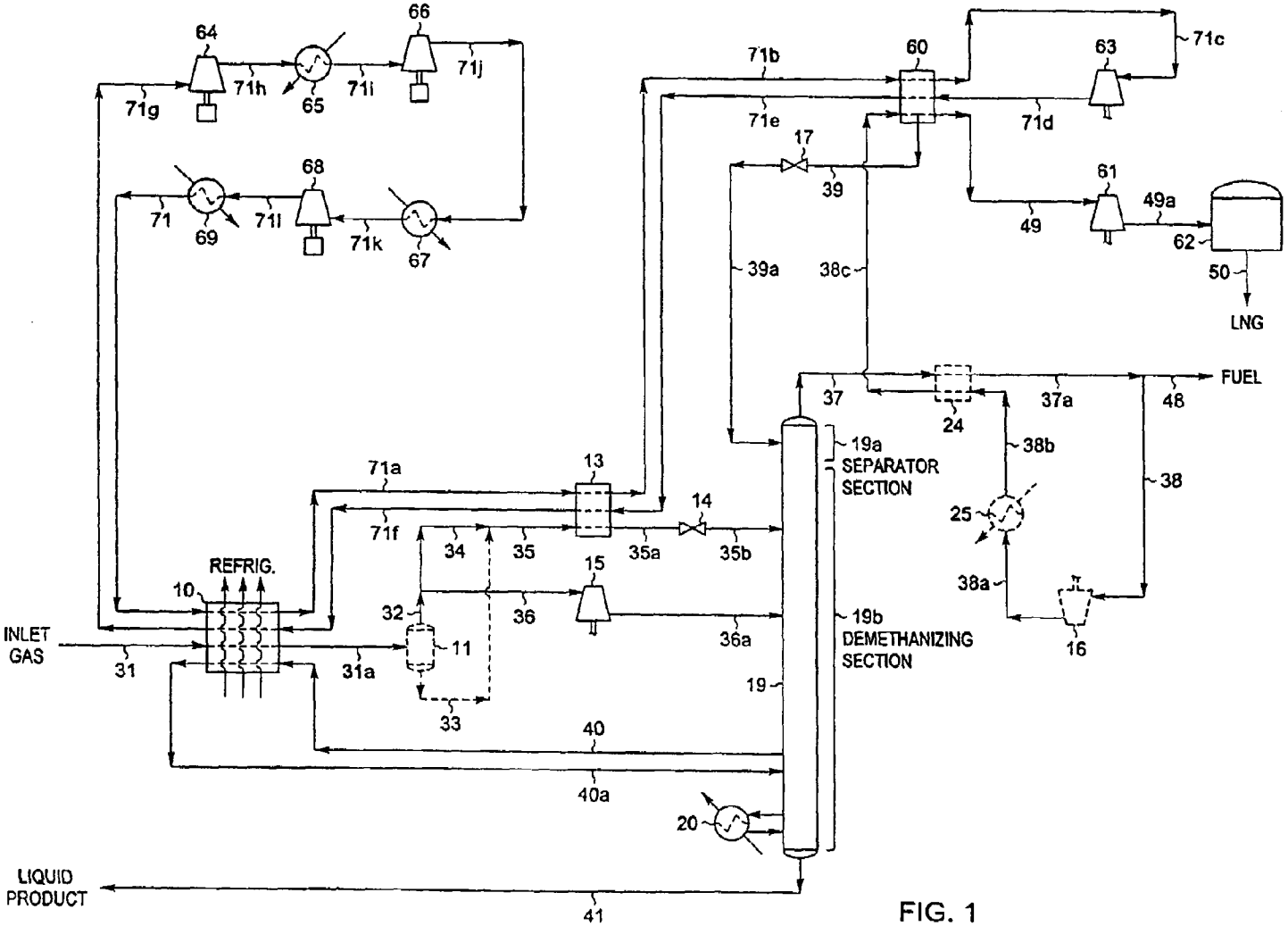
FIG. 1 is a flow diagram of a natural gas liquefaction plant adapted for co-production of NGL in accordance with the present invention.

Referring now to FIG. 1, we begin with an illustration of a process in accordance with the present invention where it is desired to produce an NGL co-product containing the majority of the ethane and heavier components in the natural gas feed stream. In this simulation of the present invention, inlet gas enters the plant at 90° F. [32° C.] and 1285 psia [8,860 kPa(a)] as stream 31. If the inlet gas contains a concentration of carbon dioxide and/or sulfur compounds which would prevent the product streams from meeting specifications, these compounds are removed by appropriate pretreatment of the feed gas (not illustrated). In addition, the feed stream is usually dehydrated to prevent hydrate (ice) formation under cryogenic conditions. Solid desiccant has typically been used for this purpose.

The feed stream 31 is cooled in heat exchanger 10 by heat exchange with refrigerant streams and demethanizer side reboiler liquids at −68° F. [−55° C.] (stream 40). Note that in all cases heat exchanger 10 is representative of either a multitude of individual heat exchangers or a single multi-pass heat exchanger, or any combination thereof. (The decision as to whether to use more than one heat exchanger for the indicated cooling services will depend on a number of factors including, but not limited to, inlet gas flow rate, heat exchanger size, stream temperatures, etc.) The cooled stream 31*a* enters separator 11 at −30° F. [−34° C.] and 1278 psia [8,812 kPa(a)] where the vapor (stream 32) is separated from the condensed liquid (stream 33).

The vapor (stream 32) from separator 11 is divided into two streams, 34 and 36. Stream 34, containing about 20% of the total vapor, is combined with the condensed liquid, stream 33, to form stream 35. Combined stream 35 passes through heat exchanger 13 in heat exchange relation with refrigerant stream 71*e*, resulting in cooling and substantial condensation of stream 35*a*. The substantially condensed stream 35*a* at −120° F. [−85° C.] is then flash expanded through an appropriate expansion device, such as expansion valve 14, to the operating pressure (approximately 465 psia [3,206 kPa (a)]) of fractionation tower 19. During expansion a portion of the stream is vaporized, resulting in cooling of the total stream. In the process illustrated in FIG. 1, the expanded stream 35*b* leaving expansion valve 14 reaches a temperature of −122° F. [−86° C.], and is supplied at a mid-point feed position in demethanizing section 19*b* of fractionation tower 19.

The remaining 80% of the vapor from separator 11 (stream 36) enters a work expansion machine 15 in which mechanical energy is extracted from this portion of the high pressure feed. The machine 15 expands the vapor substantially isentropically from a pressure of about 1278 psia [8,812 kPa(a)] to the tower operating pressure, with the work expansion cooling the expanded stream 36*a* to a temperature of approximately −103° F. [−75° C.]. The typical commercially available expanders are capable of recovering on the order of 80-85% of the work theoretically available in an ideal isentropic expansion. The work recovered is often used to drive a centrifugal compressor (such as item 16) that can be used to re-compress the tower overhead gas (stream 38), for example. The expanded and partially condensed stream 36*a* is supplied as feed to distillation column 19 at a lower mid-column feed point.

The demethanizer in fractionation tower 19 is a conventional distillation column containing a plurality of vertically spaced trays, one or more packed beds, or some combination of trays and packing. As is often the case in natural gas processing plants, the fractionation tower may consist of two sections. The upper section 19*a* is a separator wherein the top feed is divided into its respective vapor and liquid portions, and wherein the vapor rising from the lower distillation or demethanizing section 19*b* is combined with the vapor portion (if any) of the top feed to form the cold demethanizer overhead vapor (stream 37) which exits the top of the tower at −135° F. [−93° C.]. The lower, demethanizing section 19*b* contains the trays and/or packing and provides the necessary contact between the liquids falling downward and the vapors rising upward. The demethanizing section also includes one or more reboilers (such as reboiler 20) which heat and vaporize a portion of the liquids flowing down the column to provide the stripping vapors which flow up the column. The liquid product stream 41 exits the bottom of the tower at 115° F. [46° C.], based on a typical specification of a methane to ethane ratio of 0.020:1 on a molar basis in the bottom product.

The demethanizer overhead vapor (stream 37) is warmed to 90° F. [32° C.] in heat exchanger 24, and a portion of the warmed demethanizer overhead vapor is withdrawn to serve as fuel gas (stream 48) for the plant. (The amount of fuel gas that must be withdrawn is largely determined by the fuel required for the engines and/or turbines driving the gas compressors in the plant, such as refrigerant compressors 64, 66, and 68 in this example.) The remainder of the warmed demethanizer overhead vapor (stream 38) is compressed by compressor 16 driven by expansion machines 15, 61, and 63. After cooling to 100° F. [38° C.] in discharge cooler 25, stream 38*b* is further cooled to −123° F. [−86° C.] in heat exchanger 24 by cross exchange with the cold demethanizer overhead vapor, stream 37.

Stream 38*c* then enters heat exchanger 60 and is further cooled by refrigerant stream 71*d*. After cooling to an intermediate temperature, stream 38*c* is divided into two portions. The first portion, stream 49, is further cooled in heat exchanger 60 to −257° F. [−160° C.] to condense and subcool it, whereupon it enters a work expansion machine 61 in which mechanical energy is extracted from the stream. The machine 61 expands liquid stream 49 substantially isentropically from a pressure of about 562 psia [3,878 kPa(a)] to the LNG storage pressure (15.5 psia [107 kPa(a)]), slightly above atmospheric pressure. The work expansion cools the expanded stream 49*a* to a temperature of approximately −258° F. [−161° C.], whereupon it is then directed to the LNG storage tank 62 which holds the LNG product (stream 50).

Stream 39, the other portion of stream 38*c*, is withdrawn from heat exchanger 60 at −160° F. [−107° C.] and flash expanded through an appropriate expansion device, such as expansion valve 17, to the operating pressure of fractionation tower 19. In the process illustrated in FIG. 1, there is no vaporization in expanded stream 39*a*, so its temperature drops only slightly to −161° F. [−107° C.] leaving expansion valve 17. The expanded stream 39*a* is then supplied to separator section 19*a* in the upper region of fractionation tower 19. The liquids separated therein become the top feed to demethanizing section 19*b*.

All of the cooling for streams 35 and 38*c* is provided by a closed cycle refrigeration loop. The working fluid for this cycle is a mixture of hydrocarbons and nitrogen, with the composition of the mixture adjusted as needed to provide the required refrigerant temperature while condensing at a reasonable pressure using the available cooling medium. In this case, condensing with cooling water has been assumed, so a refrigerant mixture composed of nitrogen, methane, ethane, propane, and heavier hydrocarbons is used in the simulation of the FIG. 1 process. The composition of the stream, in approximate mole percent, is 7.5% nitrogen, 41.0% methane, 41.5% ethane, and 10.0% propane, with the balance made up of heavier hydrocarbons.

The refrigerant stream 71 leaves discharge cooler 69 at 100° F. [38° C.] and 607 psia [4,185 kPa(a)]. It enters heat exchanger 10 and is cooled to −31° F. [−35° C.] and partially condensed by the partially warmed expanded refrigerant stream 71*f* and by other refrigerant streams. For the FIG. 1 simulation, it has been assumed that these other refrigerant streams are commercial-quality propane refrigerant at three different temperature and pressure levels. The partially condensed refrigerant stream 71*a* then enters heat exchanger 13 for further cooling to −114° F. [−81° C.] by partially warmed expanded refrigerant stream 71*e*, condensing and partially subcooling the refrigerant (stream 71*b*). The refrigerant is further subcooled to −257° F. [−160° C.] in heat exchanger 60 by expanded refrigerant stream 71*d*. The subcooled liquid stream 71*c* enters a work expansion machine 63 in which mechanical energy is extracted from the stream as it is expanded substantially isentropically from a pressure of about 586 psia [4,040 kPa(a)] to about 34 psia [234 kPa(a)]. During expansion a portion of the stream is vaporized, resulting in cooling of the total stream to −263° F. [−164° C.] (stream 71*d*). The expanded stream 71*d* then reenters heat exchangers 60, 13, and 10 where it provides cooling to stream 38*c*, stream 35, and the refrigerant (streams 71, 71*a*, and 71*b*) as it is vaporized and superheated.

The superheated refrigerant vapor (stream 71*g*) leaves heat exchanger 10 at 93° F. [34° C.] and is compressed in three stages to 617 psia [4,254 kPa(a)]. Each of the three compression stages (refrigerant compressors 64, 66, and 68) is driven by a supplemental power source and is followed by a cooler (discharge coolers 65, 67, and 69) to remove the heat of compression. The compressed stream 71 from discharge cooler 69 returns to heat exchanger 10 to complete the cycle.

A summary of stream flow rates and energy consumption for the process illustrated in FIG. 1 is set forth in the following table:

TABLE I (FIG. 1)
Stream Flow Summary—Lb. Moles/Hr [kg moles/Hr]

| Stream | Methane | Ethane | Propane | Butanes+ | Total |
|---|---|---|---|---|---|
| 31 | 40,977 | 3,861 | 2,408 | 1,404 | 48,656 |
| 32 | 32,360 | 2,675 | 1,469 | 701 | 37,209 |
| 33 | 8,617 | 1,186 | 939 | 703 | 11,447 |
| 34 | 6,472 | 535 | 294 | 140 | 7,442 |
| 36 | 25,888 | 2,140 | 1,175 | 561 | 29,767 |
| 37 | 47,771 | 223 | 0 | 0 | 48,000 |
| 39 | 6,867 | 32 | 0 | 0 | 6,900 |
| 41 | 73 | 3,670 | 2,408 | 1,404 | 7,556 |
| 48 | 3,168 | 15 | 0 | 0 | 3,184 |
| 50 | 37,736 | 176 | 0 | 0 | 37,916 |

| | | |
|---|---|---|
| Recoveries in NGL* | | |
| Ethane | 95.06% | |
| Propane | 100.00% | |
| Butanes+ | 100.00% | |
| Production Rate | 308,147 Lb/Hr | [308,147 kg/Hr] |
| LNG Product | | |
| Production Rate | 610,813 Lb/Hr | [610,813 kg/Hr] |
| Purity* | 99.52% | |
| Lower Heating Value | 912.3 BTU/SCF | [33.99 MJ/m$^3$] |
| Power | | |
| Refrigerant Compression | 103,957 HP | [170,904 kW] |
| Propane Compression | 33,815 HP | [55,591 kW] |
| Total Compression | 137,772 HP | [226,495 kW] |
| Utility Heat | | |
| Demethanizer Reboiler | 29,364 MBTU/Hr | [18,969 kW] |

*(Based on un-rounded flow rates)

The efficiency of LNG production processes is typically compared using the "specific power consumption" required, which is the ratio of the total refrigeration compression power to the total liquid production rate. Published information on the specific power consumption for prior art processes for producing LNG indicates a range of 0.168 HP-Hr/Lb [0.276 kW-Hr/kg] to 0.182 HP-Hr/Lb [0.300 kW-Hr/kg], which is believed to be based on an on-stream factor of 340 days per year for the LNG production plant. On this same basis, the specific power consumption for the FIG. 1 embodiment of the present invention is 0.161 HP-Hr/Lb [0.265 kW-Hr/kg], which gives an efficiency improvement of 4-13% over the prior art processes. Further, it should be noted that the specific power consumption for the prior art processes is based on co-producing only an LPG ($C_3$ and heavier hydrocarbons) or condensate ($C_4$ and heavier hydrocarbons) liquid stream at relatively low recovery levels, not an NGL ($C_2$ and heavier hydrocarbons) liquid stream as shown for this example of the present invention. The prior art processes require considerably more refrigeration power to co-produce an NGL stream instead of an LPG stream or a condensate stream.

Figure 2:
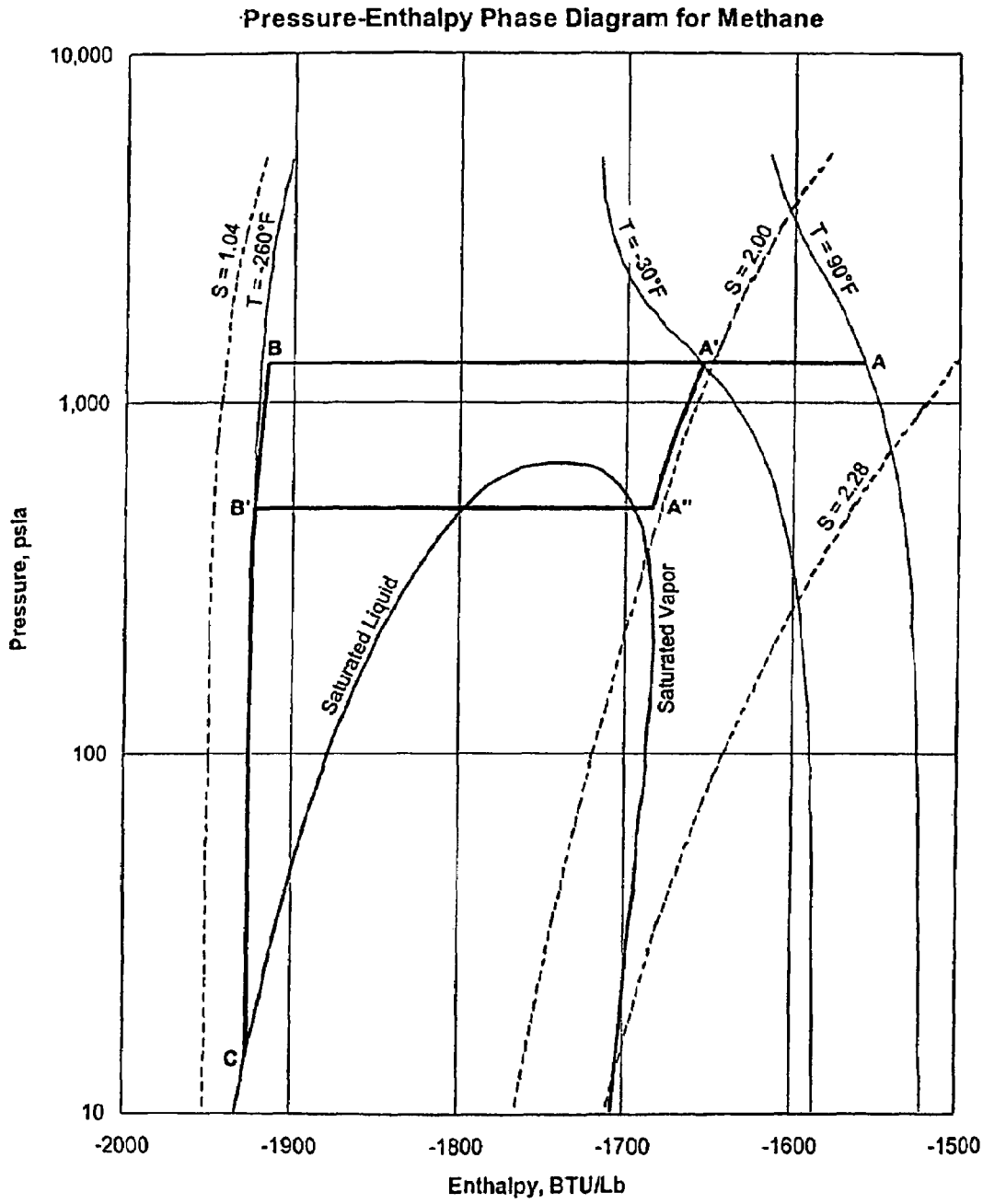
FIG. 2 is a pressure-enthalpy phase diagram for methane used to illustrate the advantages of the present invention over prior art processes.

There are two primary factors that account for the improved efficiency of the present invention. The first factor can be understood by examining the thermodynamics of the liquefaction process when applied to a high pressure gas stream such as that considered in this example. Since the primary constituent of this stream is methane, the thermodynamic properties of methane can be used for the purposes of comparing the liquefaction cycle employed in the prior art processes versus the cycle used in the present invention. FIG. 2 contains a pressure-enthalpy phase diagram for methane. In most of the prior art liquefaction cycles, all cooling of the gas stream is accomplished while the stream is at high pressure (path A-B), whereupon the stream is then expanded (path B-C) to the pressure of the LNG storage vessel (slightly above atmospheric pressure). This expansion step may employ a work expansion machine, which is typically capable of recovering on the order of 75-80% of the work theoretically available in an ideal isentropic expansion. In the interest of simplicity, fully isentropic expansion is displayed in FIG. 2 for path B-C. Even so, the enthalpy reduction provided by this work expansion is quite small, because the lines of constant entropy are nearly vertical in the liquid region of the phase diagram.

Contrast this now with the liquefaction cycle of the present invention. After partial cooling at high pressure (path A-A'), the gas stream is work expanded (path A'-A") to an intermediate pressure. (Again, fully isentropic expansion is displayed in the interest of simplicity.) The remainder of the cooling is accomplished at the intermediate pressure (path A"-B'), and the stream is then expanded (path B'-C) to the pressure of the LNG storage vessel. Since the lines of constant entropy slope less steeply in the vapor region of the phase diagram, a significantly larger enthalpy reduction is provided by the first work expansion step (path A'-A") of the present invention. Thus, the total amount of cooling required for the present invention (the sum of paths A-A' and A"-B') is less than the cooling required for the prior art processes (path A-B), reducing the refrigeration (and hence the refrigeration compression) required to liquefy the gas stream.

The second factor accounting for the improved efficiency of the present invention is the superior performance of hydrocarbon distillation systems at lower operating pressures. The hydrocarbon removal step in most of the prior art processes is performed at high pressure, typically using a scrub column that employs a cold hydrocarbon liquid as the absorbent stream to remove the heavier hydrocarbons from the incoming gas stream. Operating the scrub column at high pressure is not very efficient, as it results in the co-absorption of a significant fraction of the methane and ethane from the gas stream, which must subsequently be stripped from the absorbent liquid and cooled to become part of the LNG product. In the present invention, the hydrocarbon removal step is conducted at the intermediate pressure where the vapor-liquid equilibrium is much more favorable, resulting in very efficient recovery of the desired heavier hydrocarbons in the co-product liquid stream.

Example 2

Figure 3:
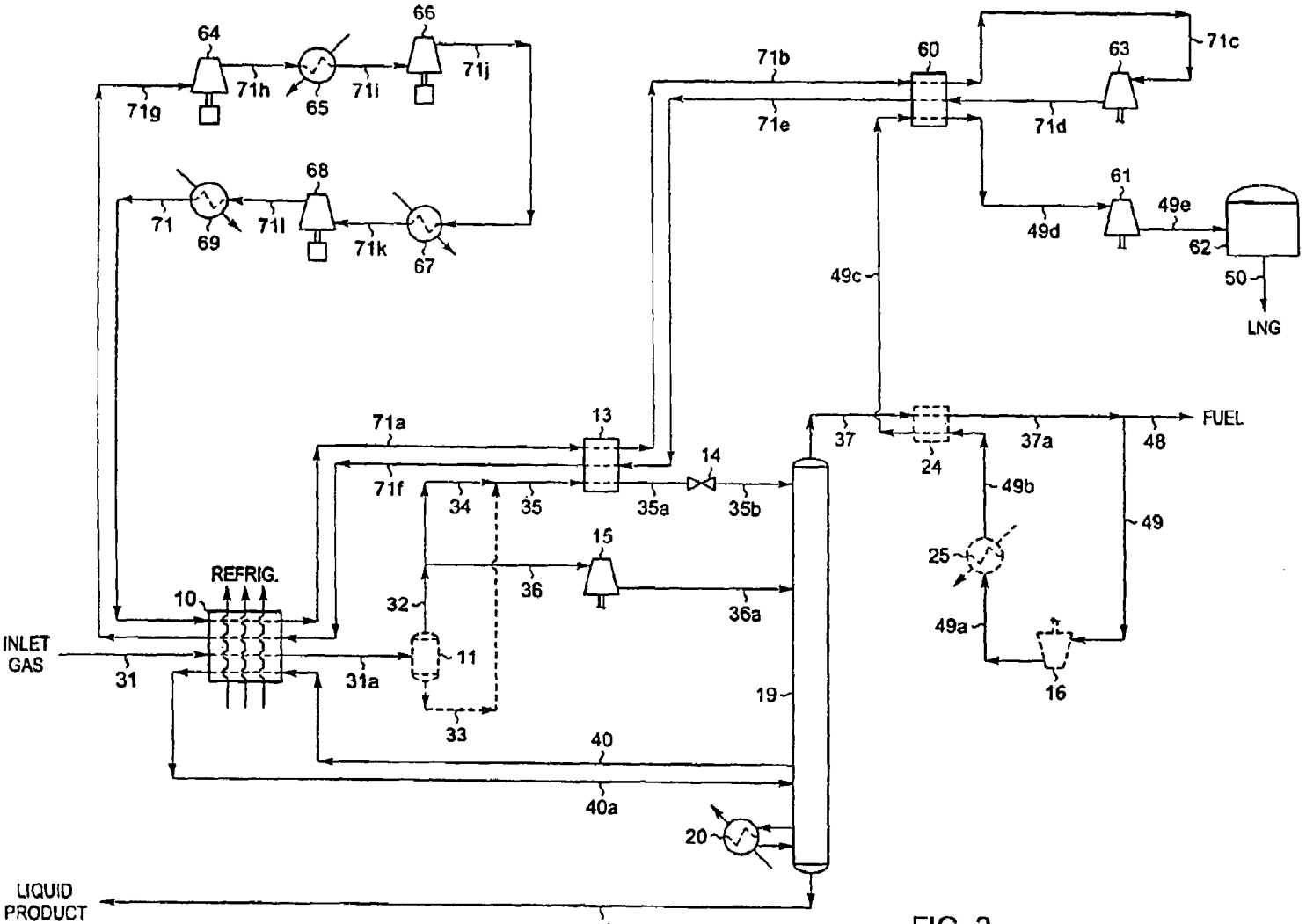
FIG. 3 is a flow diagram of an alternative natural gas liquefaction plant adapted for co-production of NGL in accordance with the present invention.

If the specifications for the LNG product will allow more of the ethane contained in the feed gas to be recovered in the LNG product, a simpler embodiment of the present invention may be employed. FIG. 3 illustrates such an alternative embodiment. The inlet gas composition and conditions considered in the process presented in FIG. 3 are the same as those in FIG. 1. Accordingly, the FIG. 3 process can be compared to the embodiment displayed in FIG. 1.

In the simulation of the FIG. 3 process, the inlet gas cooling, separation, and expansion scheme for the NGL recovery section is essentially the same as that used in FIG. 1. Inlet gas enters the plant at 90° F. [32° C.] and 1285 psia [8,860 kPa(a)] as stream 31 and is cooled in heat exchanger 10 by heat exchange with refrigerant streams and demethanizer side reboiler liquids at −35° F. [−37° C.] (stream 40). The cooled stream 31*a* enters separator 11 at −30° F. [−34° C.] and 1278 psia [8,812 kPa(a)] where the vapor (stream 32) is separated from the condensed liquid (stream 33).

The vapor (stream 32) from separator 11 is divided into two streams, 34 and 36. Stream 34, containing about 20% of the total vapor, is combined with the condensed liquid, stream 33, to form stream 35. Combined stream 35 passes through heat exchanger 13 in heat exchange relation with refrigerant stream 71*e*, resulting in cooling and substantial condensation of stream 35*a*. The substantially condensed stream 35*a* at −120° F. [−85° C.] is then flash expanded through an appropriate expansion device, such as expansion valve 14, to the operating pressure (approximately 465 psia [3,206 kPa (a)]) of fractionation tower 19. During expansion a portion of the stream is vaporized, resulting in cooling of the total stream. In the process illustrated in FIG. 3, the expanded stream 35*b* leaving expansion valve 14 reaches a temperature of −122° F. [−86° C.], and is supplied to the separator section in the upper region of fractionation tower 19. The liquids separated therein become the top feed to the demethanizing section in the lower region of fractionation tower 19.

The remaining 80% of the vapor from separator 11 (stream 36) enters a work expansion machine 15 in which mechanical energy is extracted from this portion of the high pressure feed. The machine 15 expands the vapor substantially isentropically from a pressure of about 1278 psia [8,812 kPa(a)] to the tower operating pressure, with the work expansion cooling the expanded stream 36*a* to a temperature of approximately −103° F. [−75° C.]. The expanded and partially condensed stream 36*a* is supplied as feed to distillation column 19 at a mid-column feed point.

The cold demethanizer overhead vapor (stream 37) exits the top of fractionation tower 19 at −123° F. [−86° C.]. The liquid product stream 41 exits the bottom of the tower at 118° F. [48° C.], based on a typical specification of a methane to ethane ratio of 0.020:1 on a molar basis in the bottom product.

The demethanizer overhead vapor (stream 37) is warmed to 90° F. [32° C.] in heat exchanger 24, and a portion (stream 48) is then withdrawn to serve as fuel gas for the plant. The remainder of the warmed demethanizer overhead vapor (stream 49) is compressed by compressor 16. After cooling to 100° F. [38° C.] in discharge cooler 25, stream 49*b* is further cooled to −112° F. [−80° C.] in heat exchanger 24 by cross exchange with the cold demethanizer overhead vapor, stream 37.

Stream 49*c* then enters heat exchanger 60 and is further cooled by refrigerant stream 71*d* to −257° F. [−160° C.] to condense and subcool it, whereupon it enters a work expansion machine 61 in which mechanical energy is extracted from the stream. The machine 61 expands liquid stream 49*d* substantially isentropically from a pressure of about 583 psia [4,021 kPa(a)] to the LNG storage pressure (15.5 psia [107 kPa(a)]), slightly above atmospheric pressure. The work expansion cools the expanded stream 49*e* to a temperature of approximately −258° F. [−161° C.], whereupon it is then directed to the LNG storage tank 62 which holds the LNG product (stream 50).

Similar to the FIG. 1 process, all of the cooling for streams 35 and 49*c* is provided by a closed cycle refrigeration loop. The composition of the stream used as the working fluid in the cycle for the FIG. 3 process, in approximate mole percent, is 7.5% nitrogen, 40.0% methane, 42.5% ethane, and 10.0% propane, with the balance made up of heavier hydrocarbons. The refrigerant stream 71 leaves discharge cooler 69 at 100° F. [38° C.] and 607 psia [4,185 kPa(a)]. It enters heat exchanger 10 and is cooled to −31° F. [−35° C.] and partially condensed by the partially warmed expanded refrigerant stream 71*f* and by other refrigerant streams. For the FIG. 3 simulation, it has been assumed that these other refrigerant streams are commercial-quality propane refrigerant at three different temperature and pressure levels. The partially condensed refrigerant stream 71*a* then enters heat exchanger 13 for further cooling to −121° F. [−85° C.] by partially warmed expanded refrigerant stream 71*e*, condensing and partially subcooling the refrigerant (stream 71*b*). The refrigerant is further subcooled to −257° F. [−160° C.] in heat exchanger 60 by expanded refrigerant stream 71*d*. The subcooled liquid stream 71*c* enters a work expansion machine 63 in which mechanical energy is extracted from the stream as it is expanded substantially isentropically from a pressure of about 586 psia [4,040 kPa(a)] to about 34 psia [234 kPa(a)]. During expansion a portion of the stream is vaporized, resulting in cooling of the total stream to −263° F. [−164° C.] (stream 71*d*). The expanded stream 71*d* then reenters heat exchangers 60, 13, and 10 where it provides cooling to stream 49*c*, stream 35, and the refrigerant (streams 71, 71*a*, and 71*b*) as it is vaporized and superheated.

The superheated refrigerant vapor (stream 71*g*) leaves heat exchanger 10 at 93° F. [34° C.] and is compressed in three stages to 617 psia [4,254 kPa(a)]. Each of the three compression stages (refrigerant compressors 64, 66, and 68) is driven by a supplemental power source and is followed by a cooler (discharge coolers 65, 67, and 69) to remove the heat of compression. The compressed stream 71 from discharge cooler 69 returns to heat exchanger 10 to complete the cycle.

A summary of stream flow rates and energy consumption for the process illustrated in FIG. 3 is set forth in the following table:

TABLE II (FIG. 3)
Stream Flow Summary—Lb. Moles/Hr [kg moles/Hr]

| Stream | Methane | Ethane | Propane | Butanes+ | Total |
|---|---|---|---|---|---|
| 31 | 40,977 | 3,861 | 2,408 | 1,404 | 48,656 |
| 32 | 32,360 | 2,675 | 1,469 | 701 | 37,209 |
| 33 | 8,617 | 1,186 | 939 | 703 | 11,447 |
| 34 | 6,472 | 535 | 294 | 140 | 7,442 |
| 36 | 25,888 | 2,140 | 1,175 | 561 | 29,767 |
| 37 | 40,910 | 480 | 62 | 7 | 41,465 |
| 41 | 67 | 3,381 | 2,346 | 1,397 | 7,191 |
| 48 | 2,969 | 35 | 4 | 0 | 3,009 |
| 50 | 37,941 | 445 | 58 | 7 | 38,456 |

| | | |
|---|---|---|
| Recoveries in NGL* | | |
| Ethane | 87.57% | |
| Propane | 97.41% | |
| Butanes+ | 99.47% | |
| Production Rate | 296,175 Lb/Hr | [296,175 kg/Hr] |
| LNG Product | | |
| Production Rate | 625,152 Lb/Hr | [625,152 kg/Hr] |
| Purity* | 98.66% | |
| Lower Heating Value | 919.7 BTU/SCF | [34.27 MJ/m$^3$] |
| Power | | |
| Refrigerant Compression | 96,560 HP | [158,743 kW] |
| Propane Compression | 34,724 HP | [57,086 kW] |
| Total Compression | 131,284 HP | [215,829 kW] |
| Utility Heat | | |
| Demethanizer Reboiler | 22,177 MBTU/Hr | [14,326 kW] |

*(Based on un-rounded flow rates)

Assuming an on-stream factor of 340 days per year for the LNG production plant, the specific power consumption for the FIG. 3 embodiment of the present invention is 0.153 HP-Hr/Lb [0.251 kW-Hr/kg]. Compared to the prior art processes, the efficiency improvement is 10-20% for the FIG. 3 embodiment. As noted earlier for the FIG. 1 embodiment, this efficiency improvement is possible with the present invention even though an NGL co-product is produced rather than the LPG or condensate co-product produced by the prior art processes.

Compared to the FIG. 1 embodiment, the FIG. 3 embodiment of the present invention requires about 5% less power per unit of liquid produced. Thus, for a given amount of available compression power, the FIG. 3 embodiment could liquefy about 5% more natural gas than the FIG. 1 embodiment by virtue of recovering less of the $C_2$ and heavier hydrocarbons in the NGL co-product. The choice between the FIG. 1 and the FIG. 3 embodiments of the present invention for a particular application will generally be dictated either by the monetary value of the heavier hydrocarbons in the NGL product versus their corresponding value in the LNG product, or by the heating value specification for the LNG product (since the heating value of the LNG produced by the FIG. 1 embodiment is lower than that produced by the FIG. 3 embodiment).

Example 3

Figure 4:
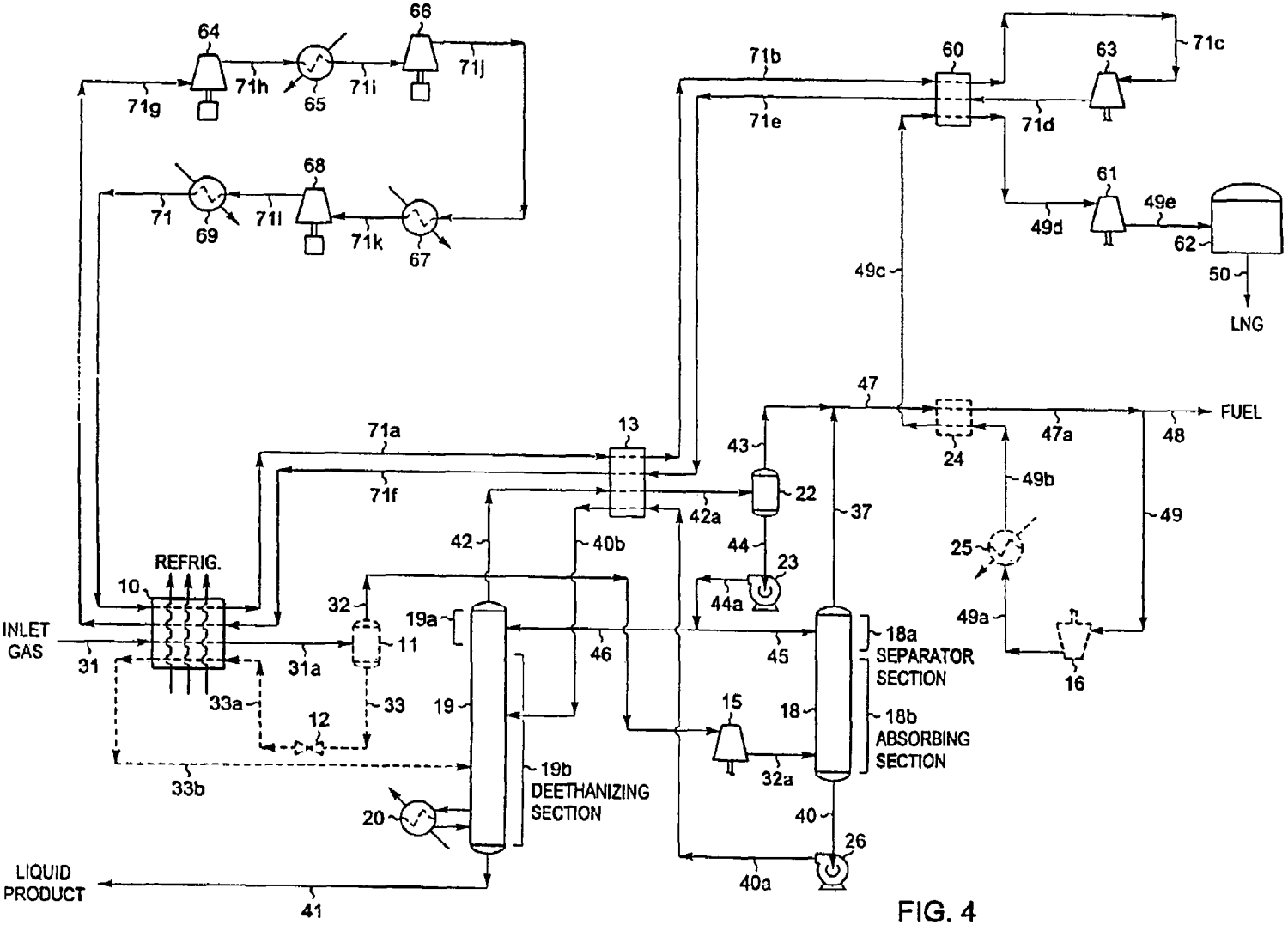
FIG. 4 is a flow diagram of an alternative natural gas liquefaction plant adapted for co-production of LPG in accordance with the present invention.

If the specifications for the LNG product will allow all of the ethane contained in the feed gas to be recovered in the LNG product, or if there is no market for a liquid co-product containing ethane, an alternative embodiment of the present invention such as that shown in FIG. 4 may be employed to produce an LPG co-product stream. The inlet gas composition and conditions considered in the process presented in FIG. 4 are the same as those in FIGS. 1 and 3. Accordingly, the FIG. 4 process can be compared to the embodiments displayed in FIGS. 1 and 3.

In the simulation of the FIG. 4 process, inlet gas enters the plant at 90° F. [32° C.] and 1285 psia [8,860 kPa(a)] as stream 31 and is cooled in heat exchanger 10 by heat exchange with refrigerant streams and flashed separator liquids at −46° F. [−43° C.] (stream 33*a*). The cooled stream 31*a* enters separator 11 at −1° F. [−18° C.] and 1278 psia [8,812 kPa(a)] where the vapor (stream 32) is separated from the condensed liquid (stream 33).

The vapor (stream 32) from separator 11 enters work expansion machine 15 in which mechanical energy is extracted from this portion of the high pressure feed. The machine 15 expands the vapor substantially isentropically from a pressure of about 1278 psia [8,812 kPa(a)] to a pressure of about 440 psia [3,034 kPa(a)] (the operating pressure of separator/absorber tower 18), with the work expansion cooling the expanded stream 32*a* to a temperature of approximately −81° F. [−63° C.]. The expanded and partially condensed stream 32*a* is supplied to absorbing section 18*b* in a lower region of separator/absorber tower 18. The liquid portion of the expanded stream comingles with liquids falling downward from the absorbing section and the combined liquid stream 40 exits the bottom of separator/absorber tower 18 at −86° F. [−66° C.]. The vapor portion of the expanded stream rises upward through the absorbing section and is contacted with cold liquid falling downward to condense and absorb the $C_3$ components and heavier components.

The separator/absorber tower 18 is a conventional distillation column containing a plurality of vertically spaced trays, one or more packed beds, or some combination of trays and packing. As is often the case in natural gas processing plants, the separator/absorber tower may consist of two sections. The upper section 18*a* is a separator wherein any vapor contained in the top feed is separated from its corresponding liquid portion, and wherein the vapor rising from the lower distillation or absorbing section 18*b* is combined with the vapor portion (if any) of the top feed to form the cold distillation stream 37 which exits the top of the tower. The lower, absorbing section 18*b* contains the trays and/or packing and provides the necessary contact between the liquids falling downward and the vapors rising upward to condense and absorb the $C_3$ components and heavier components.

The combined liquid stream 40 from the bottom of separator/absorber tower 18 is routed to heat exchanger 13 by pump 26 where it (stream 40*a*) is heated as it provides cooling of deethanizer overhead (stream 42) and refrigerant (stream 71*a*). The combined liquid stream is heated to −24° F. [−31° C.], partially vaporizing stream 40*b* before it is supplied as a mid-column feed to deethanizer 19. The separator liquid (stream 33) is flash expanded to slightly above the operating pressure of deethanizer 19 by expansion valve 12, cooling stream 33 to −46° F. [−43° C.] (stream 33*a*) before it provides cooling to the incoming feed gas as described earlier. Stream 33*b*, now at 85° F. [29° C.], then enters deethanizer 19 at a lower mid-column feed point. In the deethanizer, streams 40*b* and 33*b* are stripped of their methane and $C_2$ components. The deethanizer in tower 19, operating at about 453 psia [3,123 kPa(a)], is also a conventional distillation column containing a plurality of vertically spaced trays, one or more packed beds, or some combination of trays and packing. The deethanizer tower may also consist of two sections: an upper separator section 19*a* wherein any vapor contained in the top feed is separated from its corresponding liquid portion, and wherein the vapor rising from the lower distillation or deethanizing section 19*b* is combined with the vapor portion (if any) of the top feed to form distillation stream 42 which exits the top of the tower; and a lower, deethanizing section 19*b* that contains the trays and/or packing to provide the necessary contact between the liquids falling downward and the vapors rising upward. The deethanizing section 19*b* also includes one or more reboilers (such as reboiler 20) which heat and vaporize a portion of the liquid at the bottom of the column to provide the stripping vapors which flow up the column to strip the liquid product, stream 41, of methane and $C_2$ components. A typical specification for the bottom liquid product is to have an ethane to propane ratio of 0.020:1 on a molar basis. The liquid product stream 41 exits the bottom of the deethanizer at 214° F. [101° C.].

The operating pressure in deethanizer 19 is maintained slightly above the operating pressure of separator/absorber tower 18. This allows the deethanizer overhead vapor (stream 42) to pressure flow through heat exchanger 13 and thence into the upper section of separator/absorber tower 18. In heat exchanger 13, the deethanizer overhead at −19° F. [−28° C.] is directed in heat exchange relation with the combined liquid stream (stream 40*a*) from the bottom of separator/absorber tower 18 and flashed refrigerant stream 71*e*, cooling the stream to −89° F. [−67° C.] (stream 42*a*) and partially condensing it. The partially condensed stream enters reflux drum 22 where the condensed liquid (stream 44) is separated from the uncondensed vapor (stream 43). Stream 43 combines with the distillation vapor stream (stream 37) leaving the upper region of separator/absorber tower 18 to form cold residue gas stream 47. The condensed liquid (stream 44) is pumped to higher pressure by pump 23, whereupon stream 44*a* is divided into two portions. One portion, stream 45, is routed to the upper separator section of separator/absorber tower 18 to serve as the cold liquid that contacts the vapors rising upward through the absorbing section. The other portion is supplied to deethanizer 19 as reflux stream 46, flowing to a top feed point on deethanizer 19 at −89° F. [−67° C.].

The cold residue gas (stream 47) is warmed from −94° F. [−70° C.] to 94° F. [34° C.] in heat exchanger 24, and a portion (stream 48) is then withdrawn to serve as fuel gas for the plant. The remainder of the warmed residue gas (stream 49) is compressed by compressor 16. After cooling to 100° F. [38° C.] in discharge cooler 25, stream 49*b* is further cooled to −78° F. [−61° C.] in heat exchanger 24 by cross exchange with the cold residue gas, stream 47.

Stream 49*c* then enters heat exchanger 60 and is further cooled by refrigerant stream 71*d* to −255° F. [−160° C.] to condense and subcool it, whereupon it enters a work expansion machine 61 in which mechanical energy is extracted from the stream. The machine 61 expands liquid stream 49*d* substantially isentropically from a pressure of about 648 psia [4,465 kPa(a)] to the LNG storage pressure (15.5 psia [107 kPa(a)]), slightly above atmospheric pressure. The work expansion cools the expanded stream 49*e* to a temperature of approximately −256° F. [−160° C.], whereupon it is then directed to the LNG storage tank 62 which holds the LNG product (stream 50).

Similar to the FIG. 1 and FIG. 3 processes, much of the cooling for stream 42 and all of the cooling for stream 49*c* is provided by a closed cycle refrigeration loop. The composition of the stream used as the working fluid in the cycle for the FIG. 4 process, in approximate mole percent, is 8.7% nitrogen, 30.0% methane, 45.8% ethane, and 11.0% propane, with the balance made up of heavier hydrocarbons. The refrigerant stream 71 leaves discharge cooler 69 at 100° F. [38° C.] and 607 psia [4,185 kPa(a)]. It enters heat exchanger 10 and is cooled to −17° F. [−27° C.] and partially condensed by the partially warmed expanded refrigerant stream 71*f* and by other refrigerant streams. For the FIG. 4 simulation, it has been assumed that these other refrigerant streams are commercial-quality propane refrigerant at three different temperature and pressure levels. The partially condensed refrigerant stream 71*a* then enters heat exchanger 13 for further cooling to −89° F. [−67° C.] by partially warmed expanded refrigerant stream 71*e*, further condensing the refrigerant (stream 71*b*). The refrigerant is totally condensed and then subcooled to −255° F. [−160° C.] in heat exchanger 60 by expanded refrigerant stream 71*d*. The subcooled liquid stream 71*c* enters a work expansion machine 63 in which mechanical energy is extracted from the stream as it is expanded substantially isentropically from a pressure of about 586 psia [4,040 kPa(a)] to about 34 psia [234 kPa(a)]. During expansion a portion of the stream is vaporized, resulting in cooling of the total stream to −264° F. [−164° C.] (stream 71*d*). The expanded stream 71*d* then reenters heat exchangers 60, 13, and 10 where it provides cooling to stream 49*c*, stream 42, and the refrigerant (streams 71, 71*a*, and 71*b*) as it is vaporized and superheated.

The superheated refrigerant vapor (stream 71*g*) leaves heat exchanger 10 at 90° F. [32° C.] and is compressed in three stages to 617 psia [4,254 kPa(a)]. Each of the three compression stages (refrigerant compressors 64, 66, and 68) is driven by a supplemental power source and is followed by a cooler (discharge coolers 65, 67, and 69) to remove the heat of compression. The compressed stream 71 from discharge cooler 69 returns to heat exchanger 10 to complete the cycle.

A summary of stream flow rates and energy consumption for the process illustrated in FIG. 4 is set forth in the following table:

TABLE III (FIG. 4)
Stream Flow Summary—Lb. Moles/Hr [kg moles/Hr]

| Stream | Methane | Ethane | Propane | Butanes+ | Total |
|---|---|---|---|---|---|
| 31 | 40,977 | 3,861 | 2,408 | 1,404 | 48,656 |
| 32 | 38,431 | 3,317 | 1,832 | 820 | 44,405 |
| 33 | 2,546 | 544 | 576 | 584 | 4,251 |
| 37 | 36,692 | 3,350 | 19 | 0 | 40,066 |
| 40 | 5,324 | 3,386 | 1,910 | 820 | 11,440 |
| 41 | 0 | 48 | 2,386 | 1,404 | 3,837 |
| 42 | 10,361 | 6,258 | 168 | 0 | 16,789 |
| 43 | 4,285 | 463 | 3 | 0 | 4,753 |
| 44 | 6,076 | 5,795 | 165 | 0 | 12,036 |
| 45 | 3,585 | 3,419 | 97 | 0 | 7,101 |
| 46 | 2,491 | 2,376 | 68 | 0 | 4,935 |
| 47 | 40,977 | 3,813 | 22 | 0 | 44,819 |
| 48 | 2,453 | 228 | 1 | 0 | 2,684 |
| 50 | 38,524 | 3,585 | 21 | 0 | 42,135 |

| | | |
|---|---|---|
| Recoveries in LPG* | | |
| Propane | 99.08% | |
| Butanes+ | 100.00% | |
| Production Rate | 197,051 Lb/Hr | [197,051 kg/Hr] |
| LNG Product | | |
| Production Rate | 726,918 Lb/Hr | [726,918 kg/Hr] |
| Purity* | 91.43% | |
| Lower Heating Value | 969.9 BTU/SCF | [36.14 MJ/m$^3$] |
| Power | | |
| Refrigerant Compression | 95,424 HP | [156,876 kW] |
| Propane Compression | 28,060 HP | [46,130 kW] |
| Total Compression | 123,484 HP | [203,006 kW] |
| Utility Heat | | |
| Demethanizer Reboiler | 55,070 MBTU/Hr | [35,575 kW] |

*(Based on un-rounded flow rates)

Assuming an on-stream factor of 340 days per year for the LNG production plant, the specific power consumption for the FIG. 4 embodiment of the present invention is 0.143 HP-Hr/Lb [0.236 kW-Hr/kg]. Compared to the prior art processes, the efficiency improvement is 17-27% for the FIG. 4 embodiment.

Compared to the FIG. 1 and FIG. 3 embodiments, the FIG. 4 embodiment of the present invention requires 6% to 11% less power per unit of liquid produced. Thus, for a given amount of available compression power, the FIG. 4 embodiment could liquefy about 6% more natural gas than the FIG. 1 embodiment or about 11% more natural gas than the FIG. 3 embodiment by virtue of recovering only the $C_3$ and heavier hydrocarbons as an LPG co-product. The choice between the FIG. 4 embodiment versus either the FIG. 1 or FIG. 3 embodiments of the present invention for a particular application will generally be dictated either by the monetary value of ethane as part of an NGL product versus its corresponding value in the LNG product, or by the heating value specification for the LNG product (since the heating value of the LNG produced by the FIG. 1 and FIG. 3 embodiments is lower than that produced by the FIG. 4 embodiment).

Example 4

Figure 5:
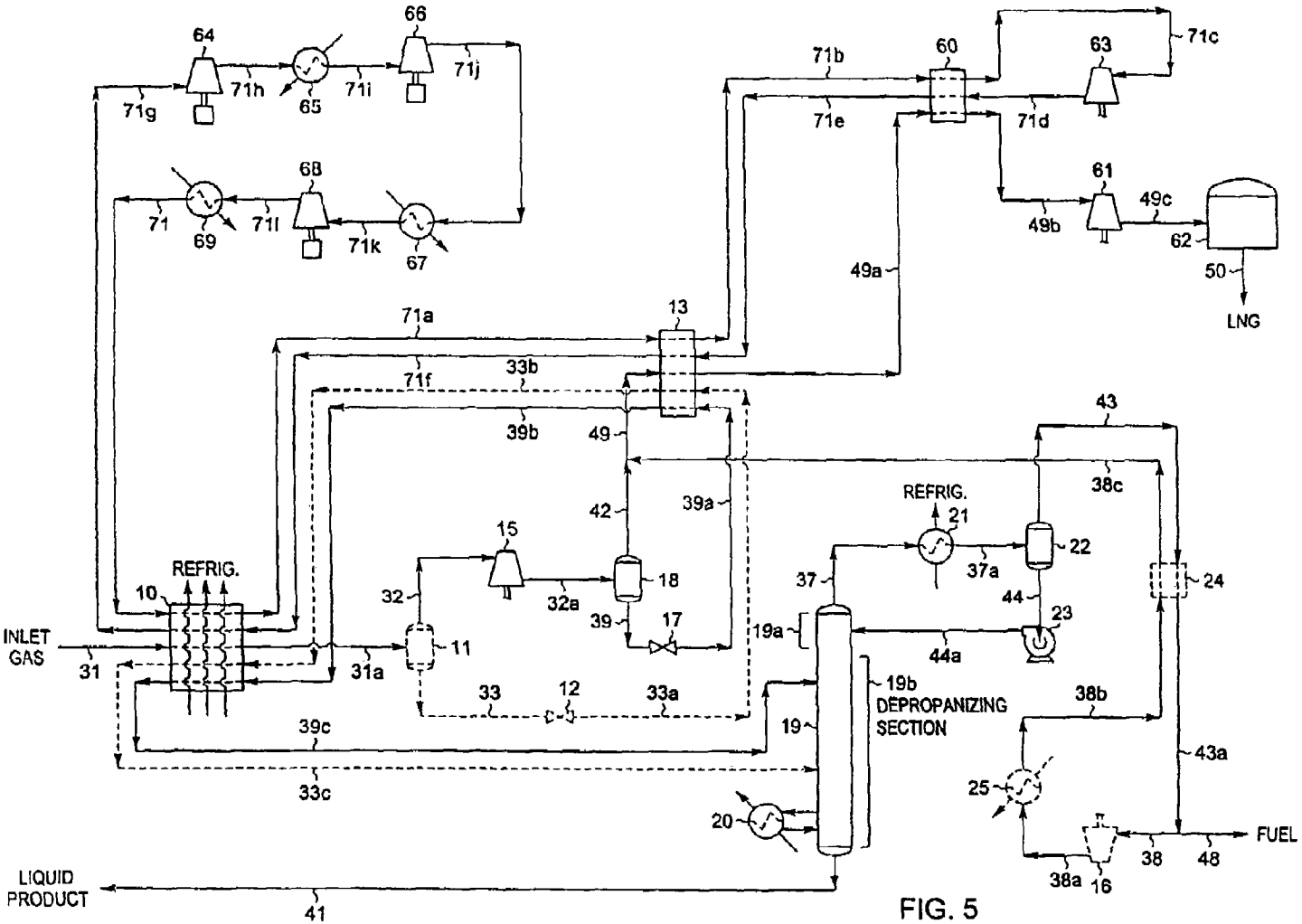
FIG. 5 is a flow diagram of an alternative natural gas liquefaction plant adapted for co-production of condensate in accordance with the present invention.

If the specifications for the LNG product will allow all of the ethane and propane contained in the feed gas to be recovered in the LNG product, or if there is no market for a liquid co-product containing ethane and propane, an alternative embodiment of the present invention such as that shown in FIG. 5 may be employed to produce a condensate co-product stream. The inlet gas composition and conditions considered in the process presented in FIG. 5 are the same as those in FIGS. 1, 3, and 4. Accordingly, the FIG. 5 process can be compared to the embodiments displayed in FIGS. 1, 3, and 4.

In the simulation of the FIG. 5 process, inlet gas enters the plant at 90° F. [32° C.] and 1285 psia [8,860 kPa(a)] as stream 31 and is cooled in heat exchanger 10 by heat exchange with refrigerant streams, flashed high pressure separator liquids at −37° F. [−38° C.] (stream 33*b*), and flashed intermediate pressure separator liquids at −37° F. [−38° C.] (stream 39*b*). The cooled stream 31*a* enters high pressure separator 11 at −30° F. [−34° C.] and 1278 psia [8,812 kPa(a)] where the vapor (stream 32) is separated from the condensed liquid (stream 33).

The vapor (stream 32) from high pressure separator 11 enters work expansion machine 15 in which mechanical energy is extracted from this portion of the high pressure feed. The machine 15 expands the vapor substantially isentropically from a pressure of about 1278 psia [8,812 kPa(a)] to a pressure of about 635 psia [4,378 kPa(a)], with the work expansion cooling the expanded stream 32*a* to a temperature of approximately −83° F. [−64° C.]. The expanded and partially condensed stream 32*a* enters intermediate pressure separator 18 where the vapor (stream 42) is separated from the condensed liquid (stream 39). The intermediate pressure separator liquid (stream 39) is flash expanded to slightly above the operating pressure of depropanizer 19 by expansion valve 17, cooling stream 39 to −108 F [−78° C.] (stream 39*a*) before it enters heat exchanger 13 and is heated as it provides cooling to residue gas stream 49 and refrigerant stream 71*a*, and thence to heat exchanger 10 to provide cooling to the incoming feed gas as described earlier. Stream 39*c*, now at −15° F. [−26° C.], then enters depropanizer 19 at an upper mid-column feed point.

The condensed liquid, stream 33, from high pressure separator 11 is flash expanded to slightly above the operating pressure of depropanizer 19 by expansion valve 12, cooling stream 33 to −93 F [−70° C.] (stream 33*a*) before it enters heat exchanger 13 and is heated as it provides cooling to residue gas stream 49 and refrigerant stream 71*a*, and thence to heat exchanger 10 to provide cooling to the incoming feed gas as described earlier. Stream 33*c*, now at 50° F. [10° C.], then enters depropanizer 19 at a lower mid-column feed point. In the depropanizer, streams 39*c* and 33*c* are stripped of their methane, $C_2$ components, and $C_3$ components. The depropanizer in tower 19, operating at about 385 psia [2,654 kPa (a)], is a conventional distillation column containing a plurality of vertically spaced trays, one or more packed beds, or some combination of trays and packing. The depropanizer tower may consist of two sections: an upper separator section 19*a* wherein any vapor contained in the top feed is separated from its corresponding liquid portion, and wherein the vapor rising from the lower distillation or depropanizing section 19*b* is combined with the vapor portion (if any) of the top feed to form distillation stream 37 which exits the top of the tower; and a lower, depropanizing section 19*b* that contains the trays and/or packing to provide the necessary contact between the liquids falling downward and the vapors rising upward. The depropanizing section 19*b* also includes one or more reboilers (such as reboiler 20) which heat and vaporize a portion of the liquid at the bottom of the column to provide the stripping vapors which flow up the column to strip the liquid product, stream 41, of methane, $C_2$ components, and $C_3$ components. A typical specification for the bottom liquid product is to have a propane to butanes ratio of 0.020:1 on a volume basis. The liquid product stream 41 exits the bottom of the deethanizer at 286° F. [141° C.].

The overhead distillation stream 37 leaves depropanizer 19 at 36° F. [2° C.] and is cooled and partially condensed by commercial-quality propane refrigerant in reflux condenser 21. The partially condensed stream 37*a* enters reflux drum 22 at 2° F. [−17° C.] where the condensed liquid (stream 44) is separated from the uncondensed vapor (stream 43). The condensed liquid (stream 44) is pumped by pump 23 to a top feed point on depropanizer 19 as reflux stream 44*a*.

The uncondensed vapor (stream 43) from reflux drum 22 is warmed to 94° F. [34° C.] in heat exchanger 24, and a portion (stream 48) is then withdrawn to serve as fuel gas for the plant. The remainder of the warmed vapor (stream 38) is compressed by compressor 16. After cooling to 100° F. [38° C.] in discharge cooler 25, stream 38*b* is further cooled to 15° F. [−9° C.] in heat exchanger 24 by cross exchange with the cool vapor, stream 43.

Stream 38*c* then combines with the intermediate pressure separator vapor (stream 42) to form cool residue gas stream 49. Stream 49 enters heat exchanger 13 and is cooled from 38° F. [−39° C.] to −102° F. [−74° C.] by separator liquids (streams 39*a* and 33*a*) as described earlier and by refrigerant stream 71*e*. Partially condensed stream 49*a* then enters heat exchanger 60 and is further cooled by refrigerant stream 71*d* to −254° F. [−159° C.] to condense and subcool it, whereupon it enters a work expansion machine 61 in which mechanical energy is extracted from the stream. The machine 61 expands liquid stream 49*b* substantially isentropically from a pressure of about 621 psia [4,282 kPa(a)] to the LNG storage pressure (15.5 psia [107 kPa(a)]), slightly above atmospheric pressure. The work expansion cools the expanded stream 49*c* to a temperature of approximately −255° F. [−159° C.], whereupon it is then directed to the LNG storage tank 62 which holds the LNG product (stream 50).

Similar to the FIG. 1, FIG. 3, and FIG. 4 processes, much of the cooling for stream 49 and all of the cooling for stream 49*a* is provided by a closed cycle refrigeration loop. The composition of the stream used as the working fluid in the cycle for the FIG. 5 process, in approximate mole percent, is 8.9% nitrogen, 34.3% methane, 41.3% ethane, and 11.0% propane, with the balance made up of heavier hydrocarbons. The refrigerant stream 71 leaves discharge cooler 69 at 100° F. [38° C.] and 607 psia [4,185 kPa(a)]. It enters heat exchanger 10 and is cooled to −30° F. [−34° C.] and partially condensed by the partially warmed expanded refrigerant stream 71*f* and by other refrigerant streams. For the FIG. 5 simulation, it has been assumed that these other refrigerant streams are commercial-quality propane refrigerant at three different temperature and pressure levels. The partially condensed refrigerant stream 71*a* then enters heat exchanger 13 for further cooling to −102° F. [−74° C.] by partially warmed expanded refrigerant stream 71*e*, further condensing the refrigerant (stream 71*b*). The refrigerant is totally condensed and then subcooled to −254° F. [−159° C.] in heat exchanger 60 by expanded refrigerant stream 71*d*. The subcooled liquid stream 71*c* enters a work expansion machine 63 in which mechanical energy is extracted from the stream as it is expanded substantially isentropically from a pressure of about 586 psia [4,040 kPa(a)] to about 34 psia [234 kPa(a)]. During expansion a portion of the stream is vaporized, resulting in cooling of the total stream to −264° F. [−164° C.] (stream 71*d*). The expanded stream 71*d* then reenters heat exchangers 60, 13, and 10 where it provides cooling to stream 49*a*, stream 49, and the refrigerant (streams 71, 71*a*, and 71*b*) as it is vaporized and superheated.

The superheated refrigerant vapor (stream 71*g*) leaves heat exchanger 10 at 93° F. [34° C.] and is compressed in three stages to 617 psia [4,254 kPa(a)]. Each of the three compression stages (refrigerant compressors 64, 66, and 68) is driven by a supplemental power source and is followed by a cooler (discharge coolers 65, 67, and 69) to remove the heat of compression. The compressed stream 71 from discharge cooler 69 returns to heat exchanger 10 to complete the cycle.

A summary of stream flow rates and energy consumption for the process illustrated in FIG. 5 is set forth in the following table:

TABLE IV (FIG. 5)
Stream Flow Summary—Lb. Moles/Hr [kg moles/Hr]

| Stream | Methane | Ethane | Propane | Butanes+ | Total |
|---|---|---|---|---|---|
| 31 | 40,977 | 3,861 | 2,408 | 1,404 | 48,656 |
| 32 | 32,360 | 2,675 | 1,469 | 701 | 37,209 |
| 33 | 8,617 | 1,186 | 939 | 703 | 11,447 |
| 38 | 13,133 | 2,513 | 1,941 | 22 | 17,610 |
| 39 | 6,194 | 1,648 | 1,272 | 674 | 9,788 |
| 41 | 0 | 0 | 22 | 1,352 | 1,375 |
| 42 | 26,166 | 1,027 | 197 | 27 | 27,421 |
| 43 | 14,811 | 2,834 | 2,189 | 25 | 19,860 |
| 48 | 1,678 | 321 | 248 | 3 | 2,250 |
| 50 | 39,299 | 3,540 | 2,138 | 49 | 45,031 |

| | | |
|---|---|---|
| Recoveries in Condensate* | | |
| Butanes | 95.04% | |
| Pentanes+ | 99.57% | |
| Production Rate | 88,390 Lb/Hr | [88,390 kg/Hr] |
| LNG Product | | |
| Production Rate | 834,183 Lb/Hr | [834,183 kg/Hr] |
| Purity* | 87.27% | |
| Lower Heating Value | 1033.8 BTU/SCF | [38.52 MJ/m$^3$] |
| Power | | |
| Refrigerant Compression | 84,974 HP | [139,696 kW] |
| Propane Compression | 39,439 HP | [64,837 kW] |
| Total Compression | 124,413 HP | [204,533 kW] |
| Utility Heat | | |
| Demethanizer Reboiler | 52,913 MBTU/Hr | [34,182 kW] |

*(Based on un-rounded flow rates)

Assuming an on-stream factor of 340 days per year for the LNG production plant, the specific power consumption for the FIG. 5 embodiment of the present invention is 0.145 HP-Hr/Lb [0.238 kW-Hr/kg]. Compared to the prior art processes, the efficiency improvement is 16-26% for the FIG. 5 embodiment.

Compared to the FIG. 1 and FIG. 3 embodiments, the FIG. 5 embodiment of the present invention requires 5% to 10% less power per unit of liquid produced. Compared to the FIG. 4 embodiment, the FIG. 5 embodiment of the present invention requires essentially the same power per unit of liquid produced. Thus, for a given amount of available compression power, the FIG. 5 embodiment could liquefy about 5% more natural gas than the FIG. 1 embodiment, about 10% more natural gas than the FIG. 3 embodiment, or about the same amount of natural gas as the FIG. 4 embodiment, by virtue of recovering only the $C_4$ and heavier hydrocarbons as a condensate co-product. The choice between the FIG. 5 embodiment versus either the FIG. 1, FIG. 3, or FIG. 4 embodiments of the present invention for a particular application will generally be dictated either by the monetary values of ethane and propane as part of an NGL or LPG product versus their corresponding values in the LNG product, or by the heating value specification for the LNG product (since the heating value of the LNG produced by the FIG. 1, FIG. 3, and FIG. 4 embodiments is lower than that produced by the FIG. 5 embodiment).

Other Embodiments

One skilled in the art will recognize that the present invention can be adapted for use with all types of LNG liquefaction plants to allow co-production of an NGL stream, an LPG stream, or a condensate stream, as best suits the needs at a given plant location. Further, it will be recognized that a variety of process configurations may be employed for recovering the liquid co-product stream. For instance, the FIGS. 1 and 3 embodiments can be adapted to recover an LPG stream or a condensate stream as the liquid co-product stream rather than an NGL stream as described earlier in Examples 1 and 2. The FIG. 4 embodiment can be adapted to recover an NGL stream containing a significant fraction of the $C_2$ components present in the feed gas, or to recover a condensate stream containing only the $C_4$ and heavier components present in the feed gas, rather than producing an LPG co-product as described earlier for Example 3. The FIG. 5 embodiment can be adapted to recover an NGL stream containing a significant fraction of the $C_2$ components present in the feed gas, or to recover an LPG stream containing a significant fraction of the $C_3$ components present in the feed gas, rather than producing a condensate co-product as described earlier for Example 4.

Figure 6:
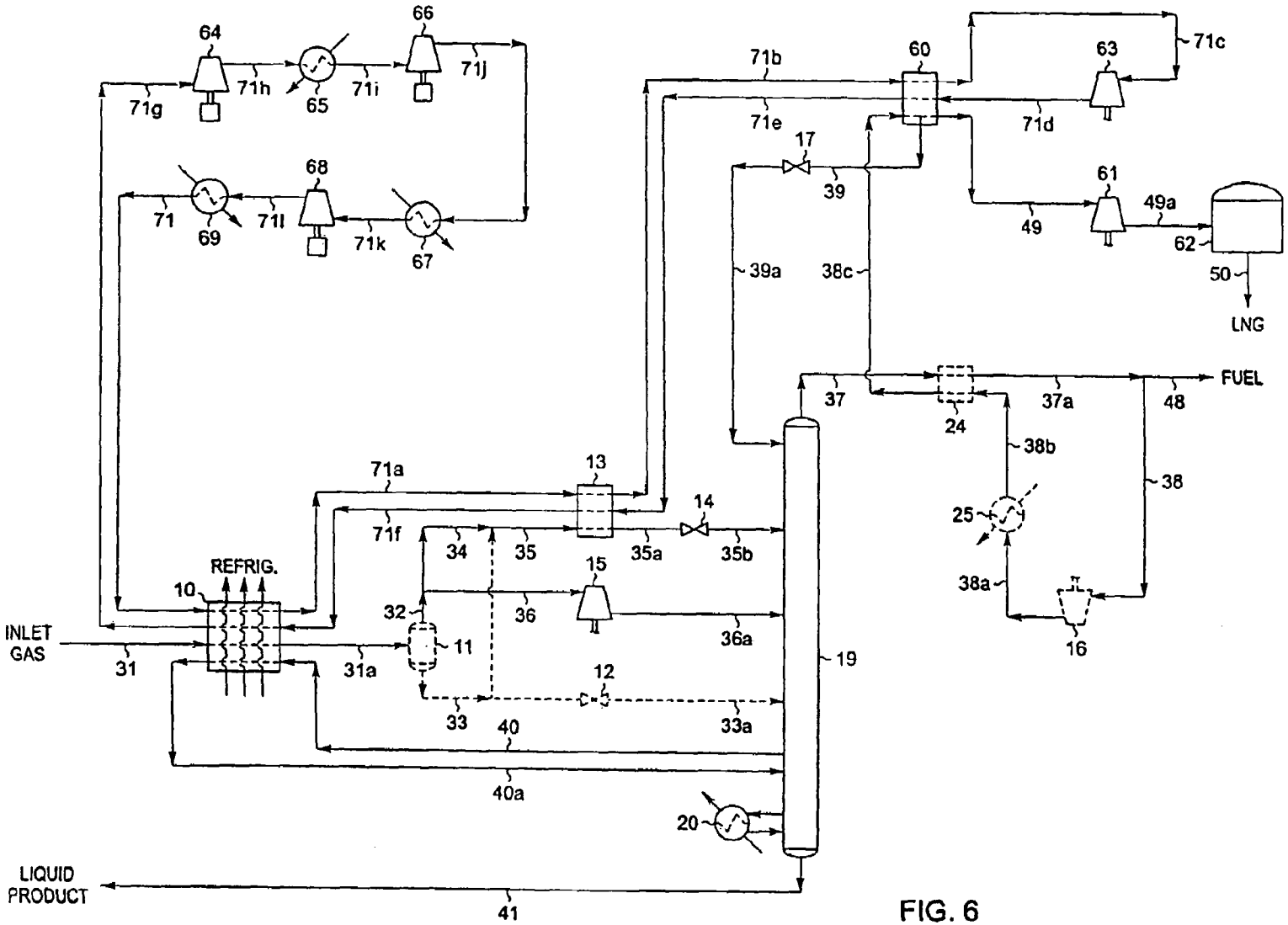
FIG. 6 is a flow diagram of an alternative natural gas liquefaction plant adapted for co-production of a liquid stream in accordance with the present invention.
Figure 7:
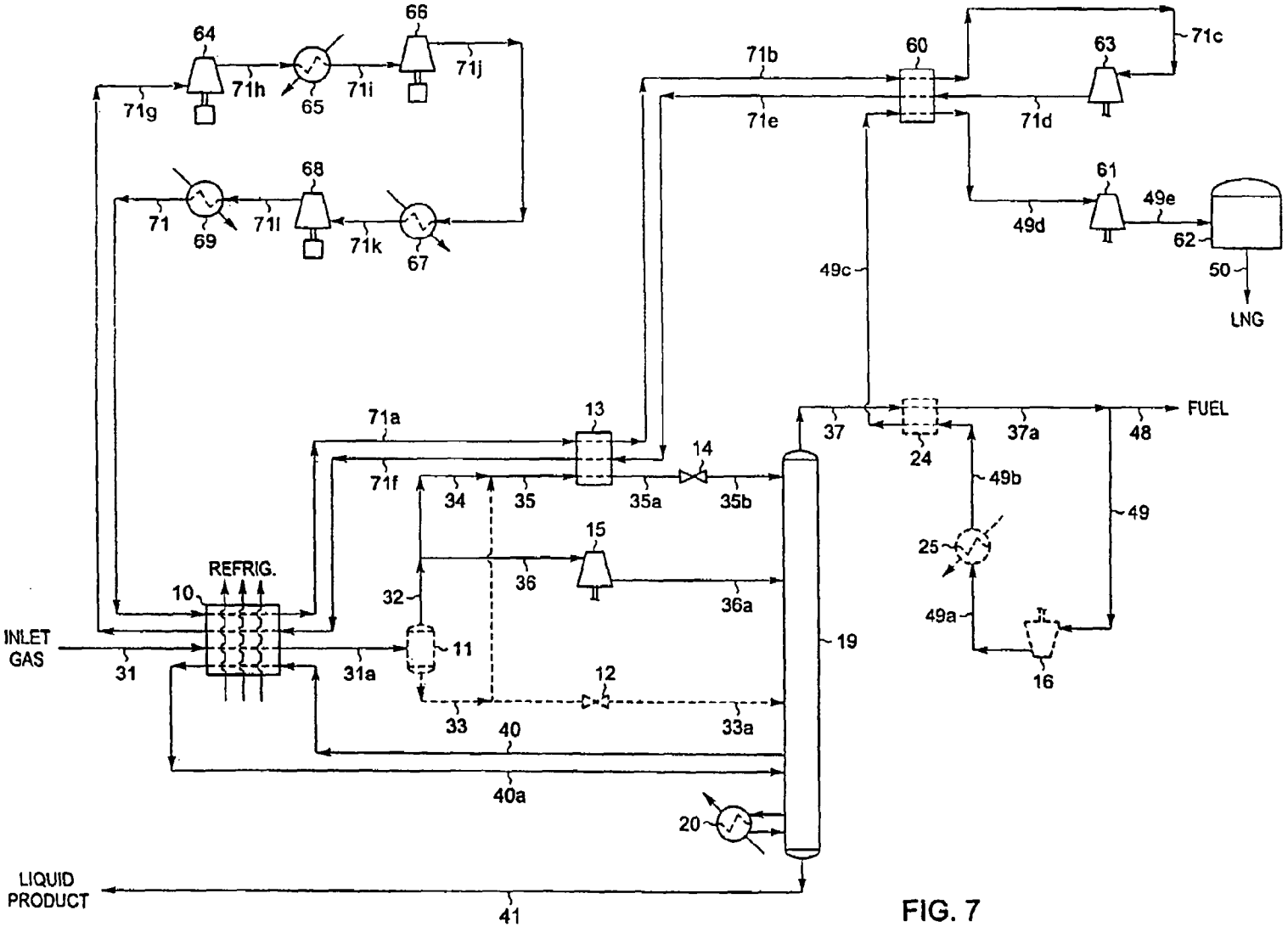
FIG. 7 is a flow diagram of an alternative natural gas liquefaction plant adapted for co-production of a liquid stream in accordance with the present invention.
Figure 8:
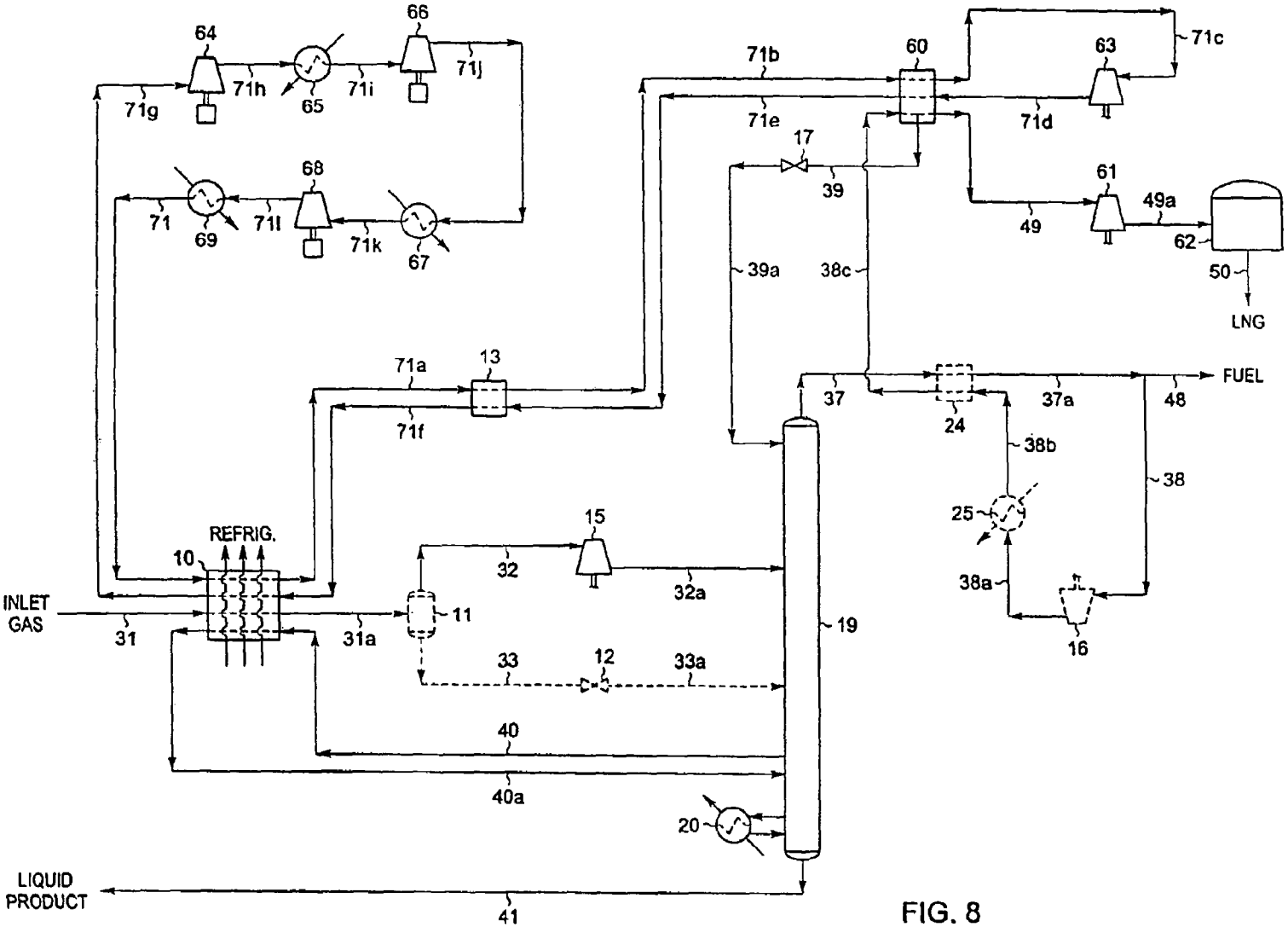
FIG. 8 is a flow diagram of an alternative natural gas liquefaction plant adapted for co-production of a liquid stream in accordance with the present invention.
Figure 9:
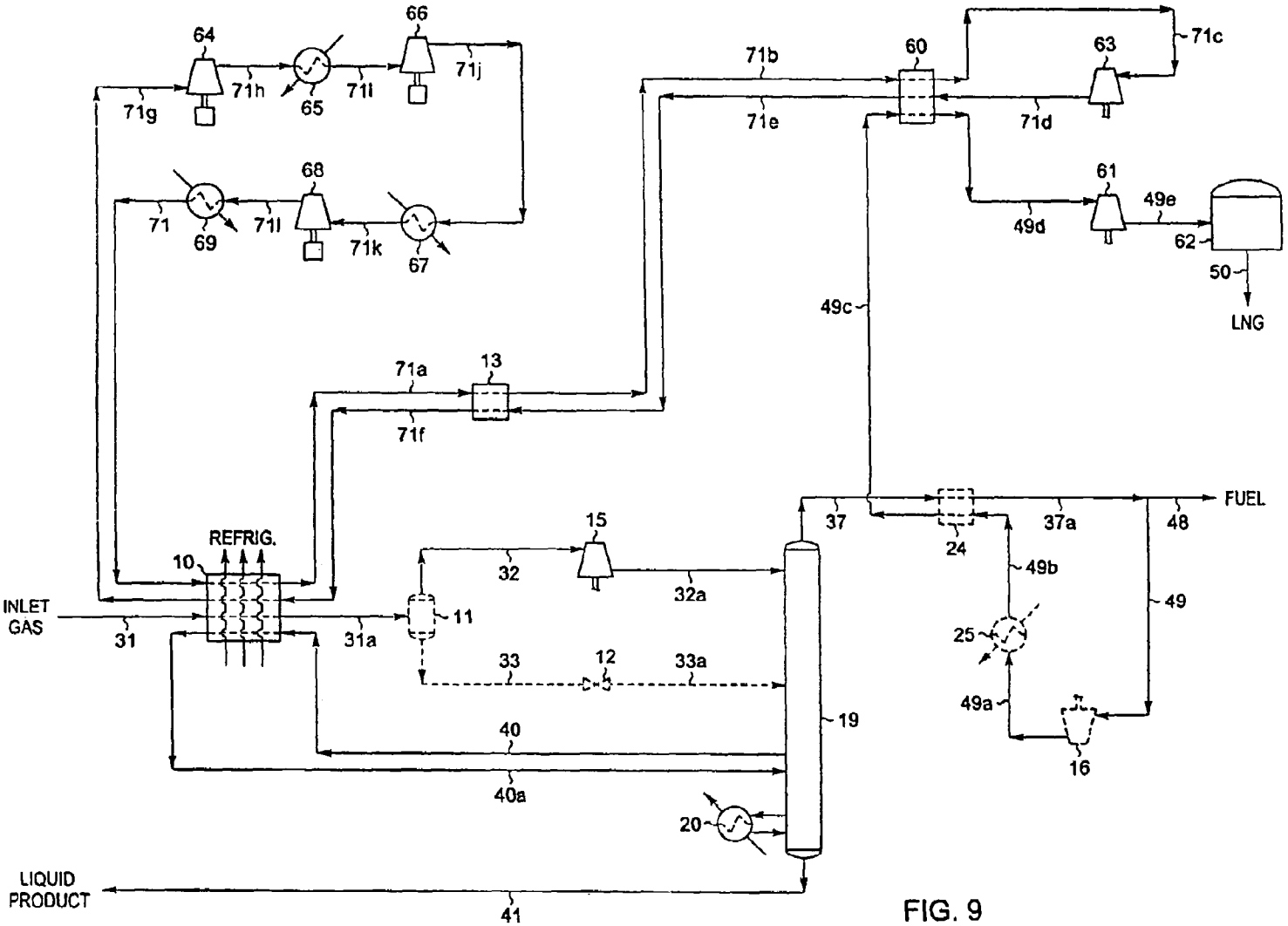
FIG. 9 is a flow diagram of an alternative natural gas liquefaction plant adapted for co-production of a liquid stream in accordance with the present invention.
Figure 10:
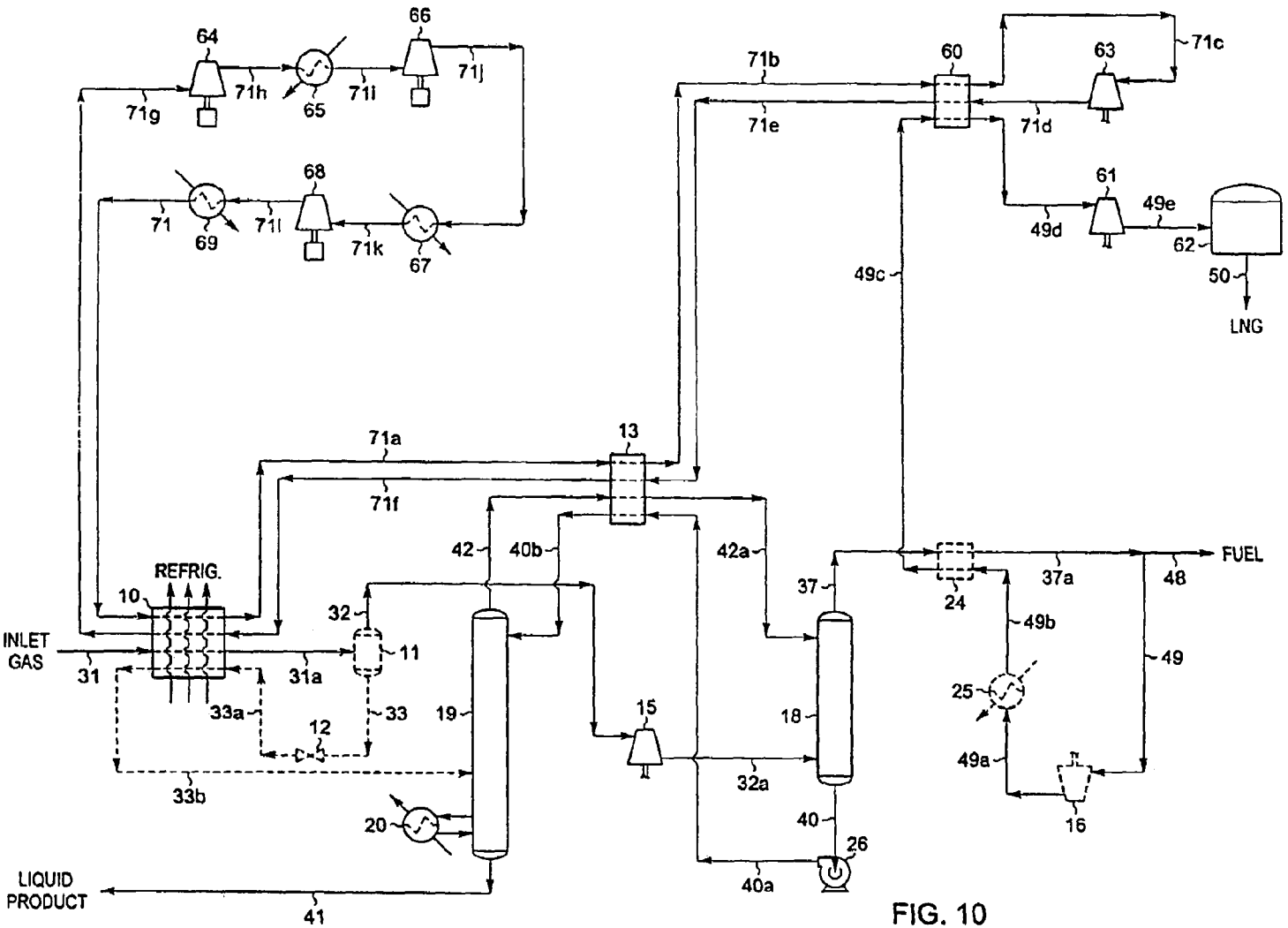
FIG. 10 is a flow diagram of an alternative natural gas liquefaction plant adapted for co-production of a liquid stream in accordance with the present invention.
Figure 11:
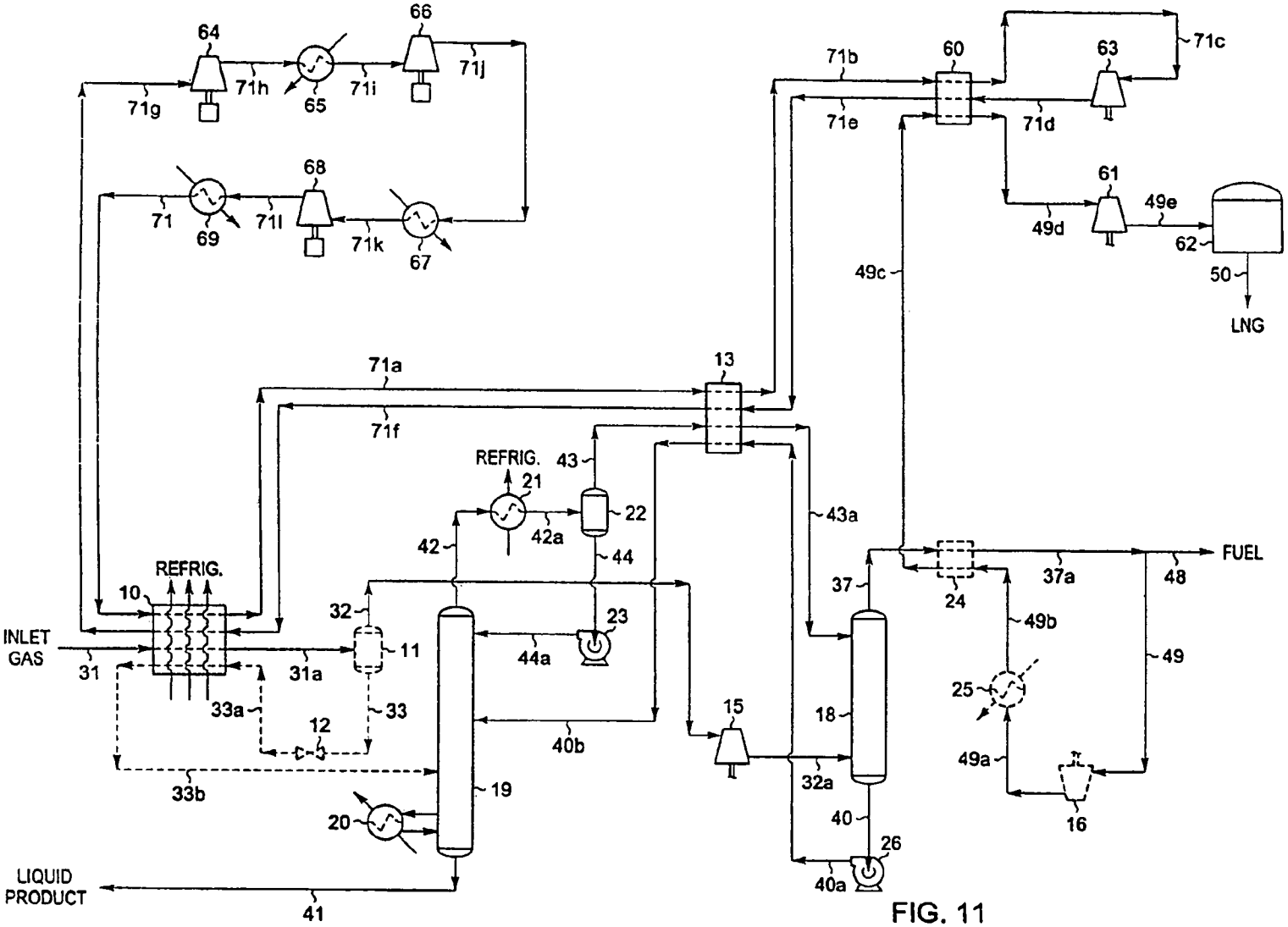
FIG. 11 is a flow diagram of an alternative natural gas liquefaction plant adapted for co-production of a liquid stream in accordance with the present invention.
Figure 12:
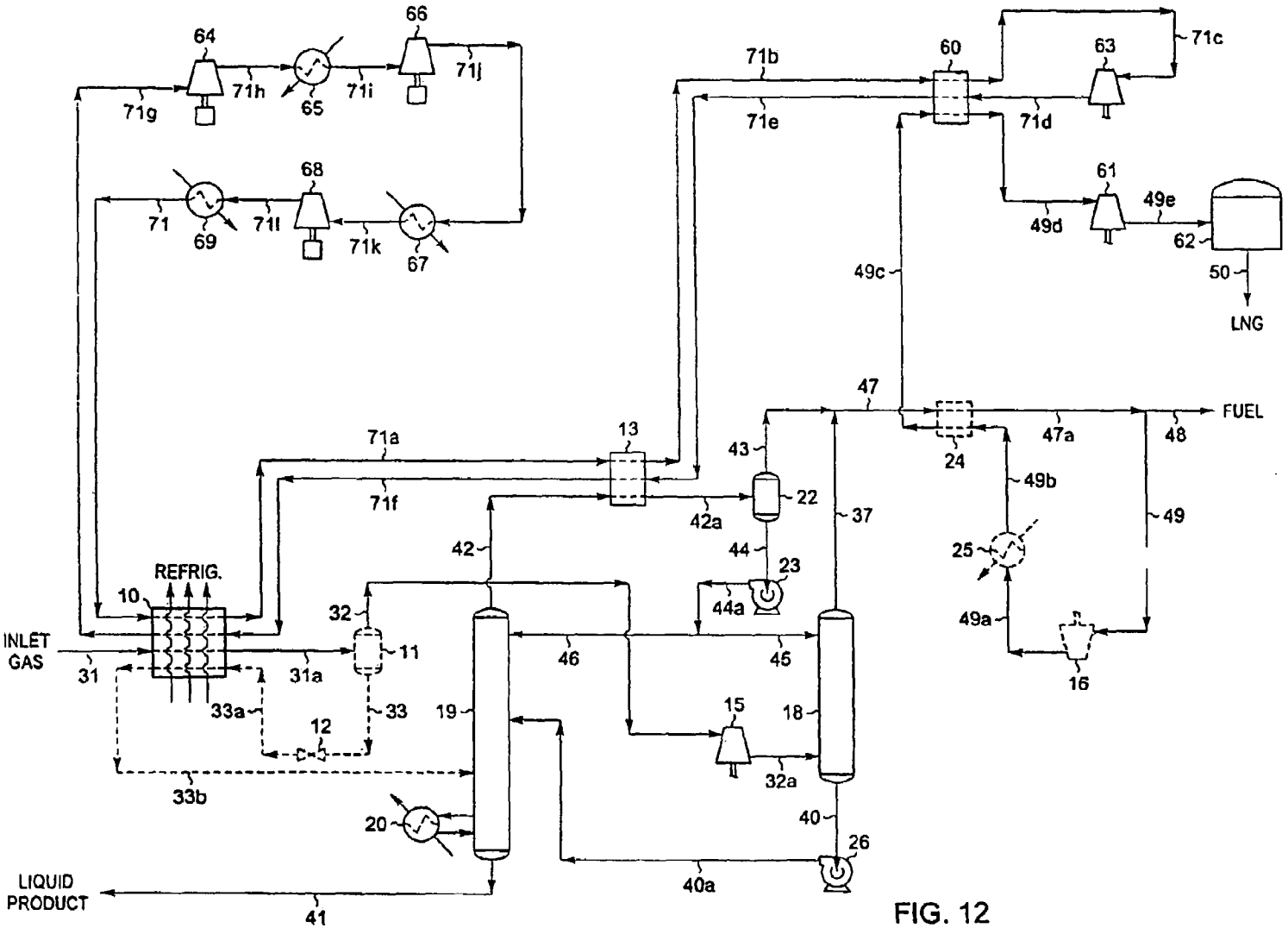
FIG. 12 is a flow diagram of an alternative natural gas liquefaction plant adapted for co-production of a liquid stream in accordance with the present invention.
Figure 13:
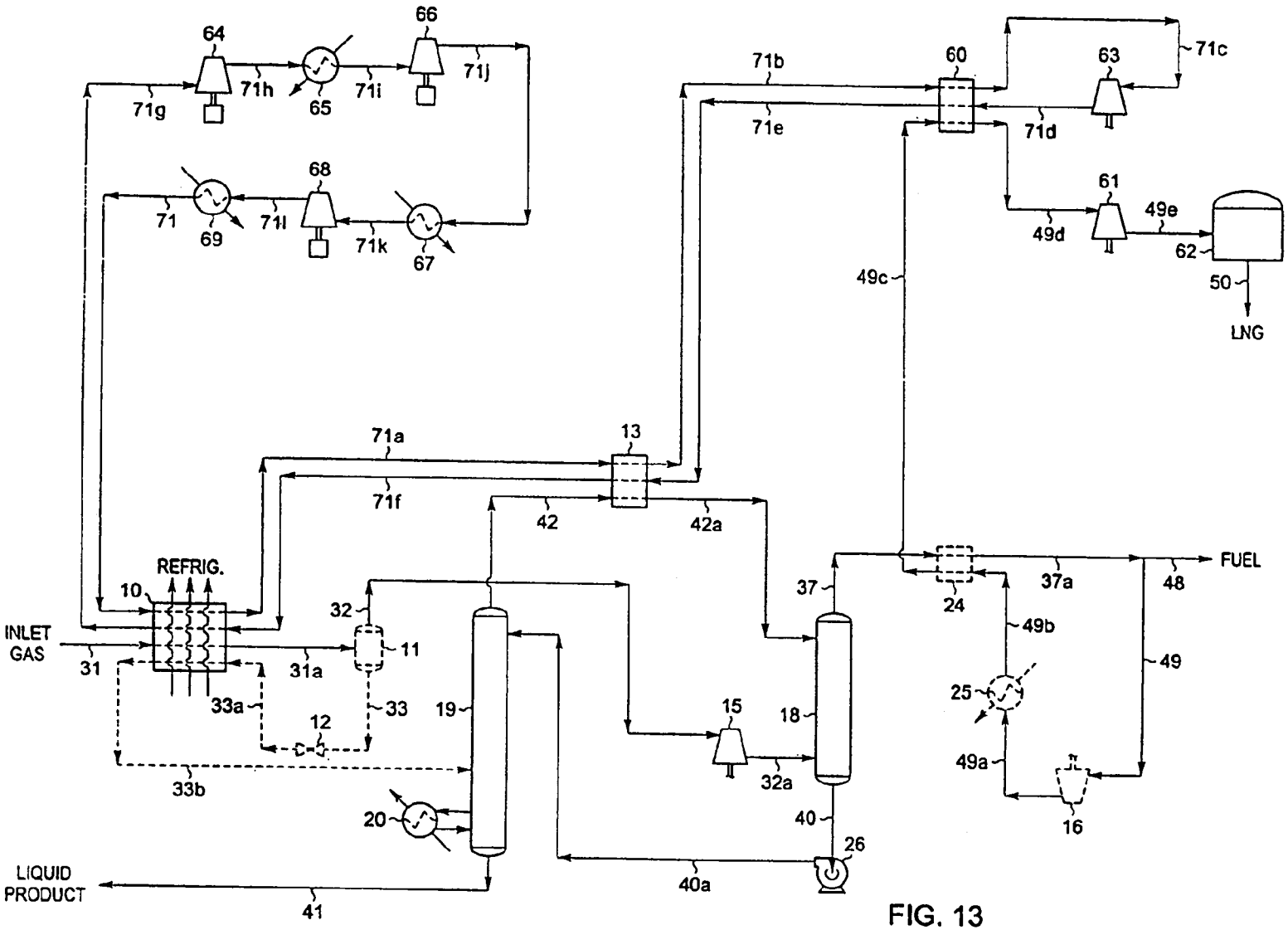
FIG. 13 is a flow diagram of an alternative natural gas liquefaction plant adapted for co-production of a liquid stream in accordance with the present invention.
Figure 14:
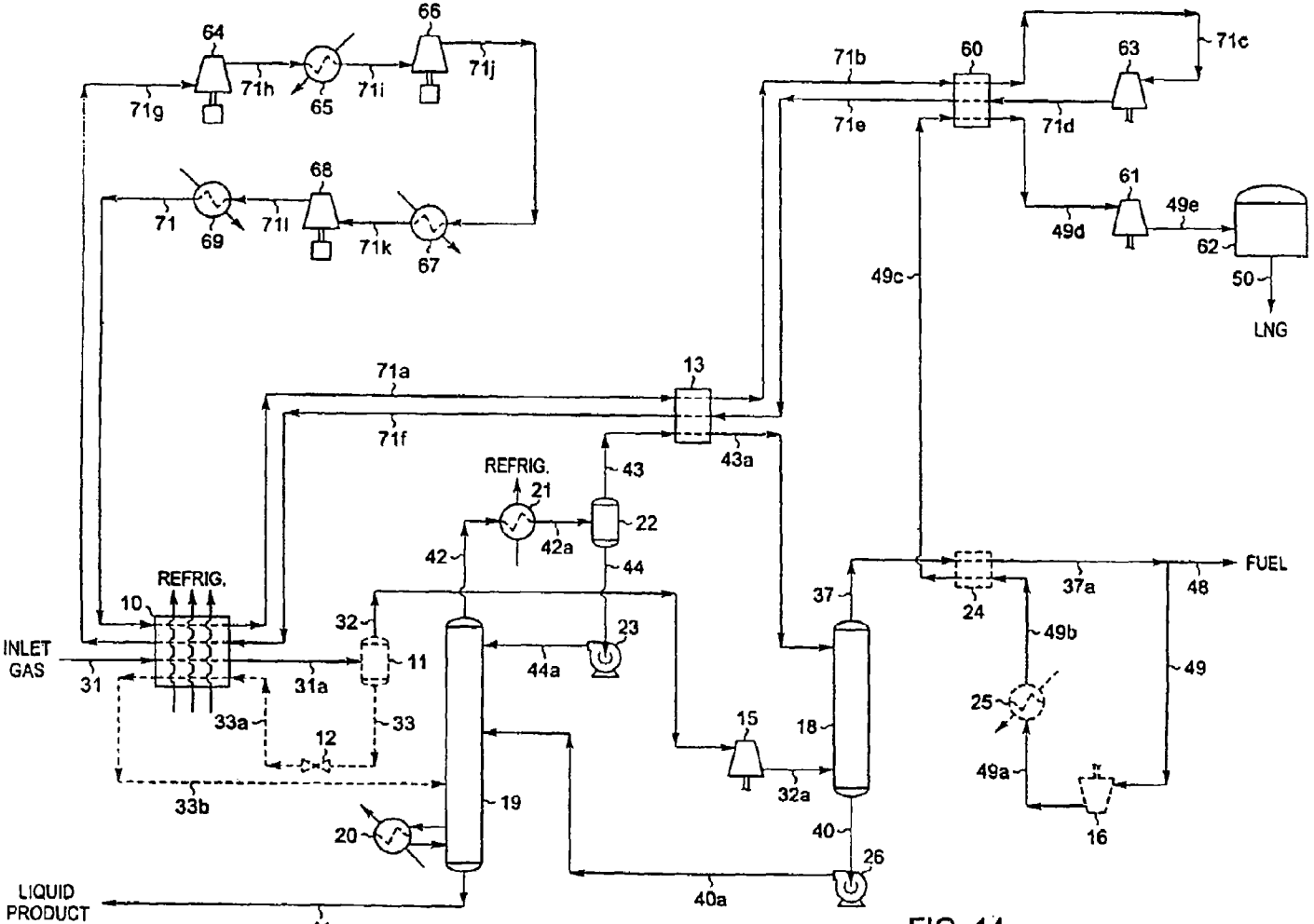
FIG. 14 is a flow diagram of an alternative natural gas liquefaction plant adapted for co-production of a liquid stream in accordance with the present invention.
Figure 15:
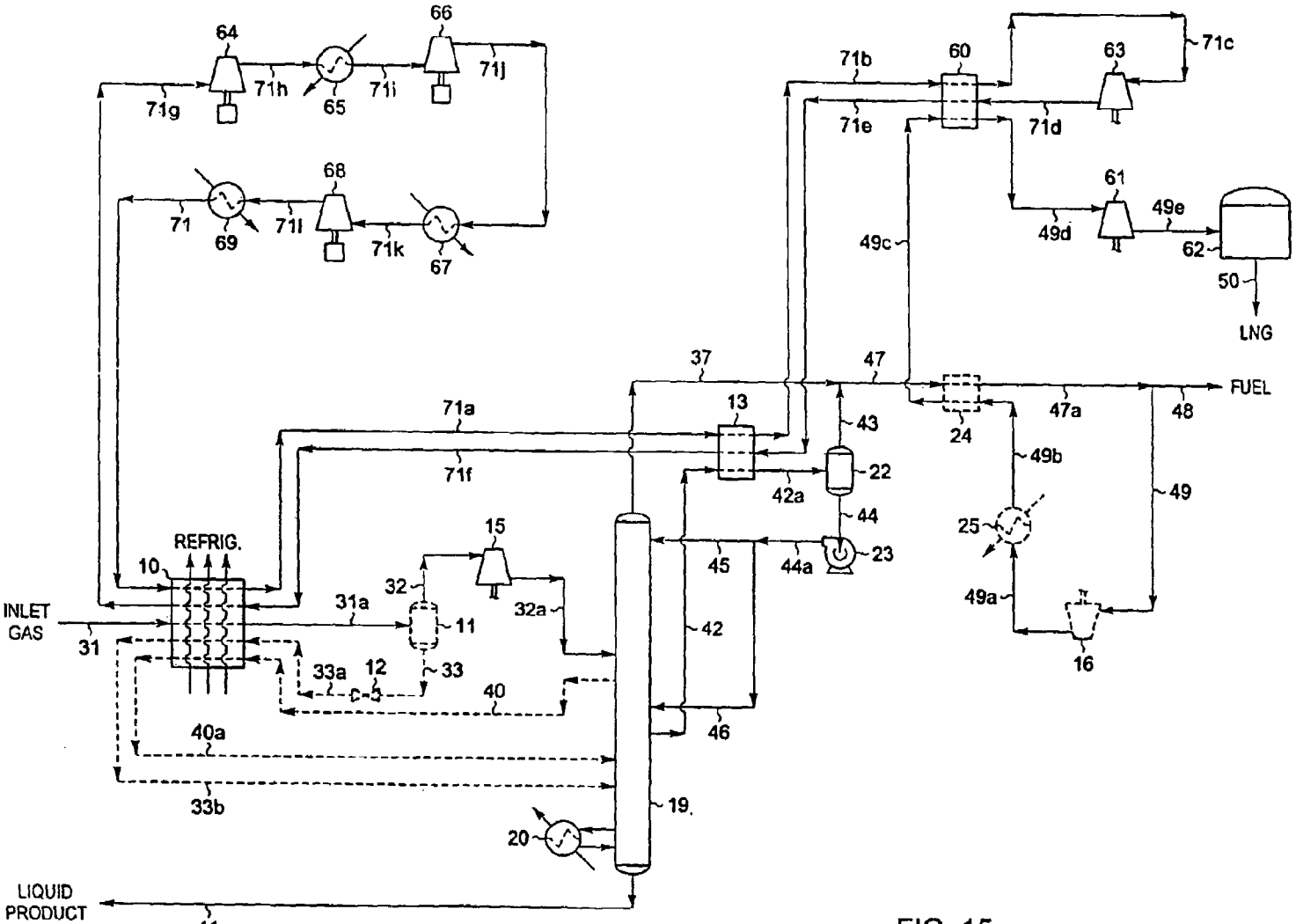
FIG. 15 is a flow diagram of an alternative natural gas liquefaction plant adapted for co-production of a liquid stream in accordance with the present invention.
Figure 16:
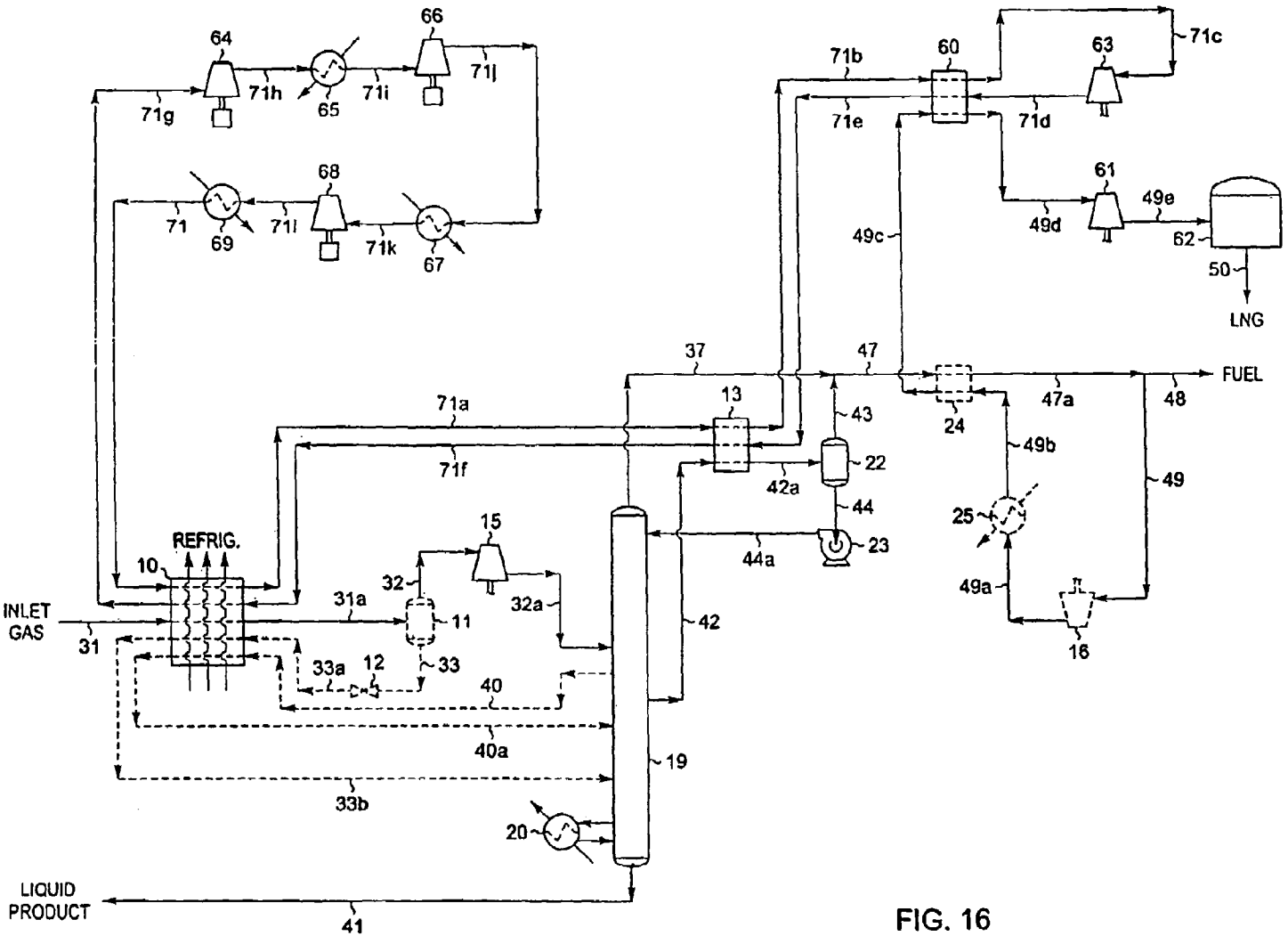
FIG. 16 is a flow diagram of an alternative natural gas liquefaction plant adapted for co-production of a liquid stream in accordance with the present invention.

FIGS. 1, 3, 4, and 5 represent the preferred embodiments of the present invention for the processing conditions indicated. FIGS. 6 through 21 depict alternative embodiments of the present invention that may be considered for a particular application. As shown in FIGS. 6 and 7, all or a portion of the condensed liquid (stream 33) from separator 11 can be supplied to fractionation tower 19 at a separate lower mid-column feed position rather than combining with the portion of the separator vapor (stream 34) flowing to heat exchanger 13. FIG. 8 depicts an alternative embodiment of the present invention that requires less equipment than the FIG. 1 and FIG. 6 embodiments, although its specific power consumption is somewhat higher. Similarly, FIG. 9 depicts an alternative embodiment of the present invention that requires less equipment than the FIG. 3 and FIG. 7 embodiments, again at the expense of a higher specific power consumption. FIGS. 10 through 14 depict alternative embodiments of the present invention that may require less equipment than the FIG. 4 embodiment, although their specific power consumptions may be higher. (Note that as shown in FIGS. 10 through 14, distillation columns or systems such as deethanizer 19 include both reboiled absorber tower designs and refluxed, reboiled tower designs.) FIGS. 15 and 16 depict alternative embodiments of the present invention that combine the functions of separator/absorber tower 18 and deethanizer 19 in the FIGS. 4 and 10 through 14 embodiments into a single fractionation column 19. Depending on the quantity of heavier hydrocarbons in the feed gas and the feed gas pressure, the cooled feed stream 31*a* leaving heat exchanger 10 may not contain any liquid (because it is above its dewpoint, or because it is above its cricondenbar), so that separator 11 shown in FIGS. 1 and 3 through 16 is not required, and the cooled feed stream can flow directly to an appropriate expansion device, such as work expansion machine 15.

Figure 17:
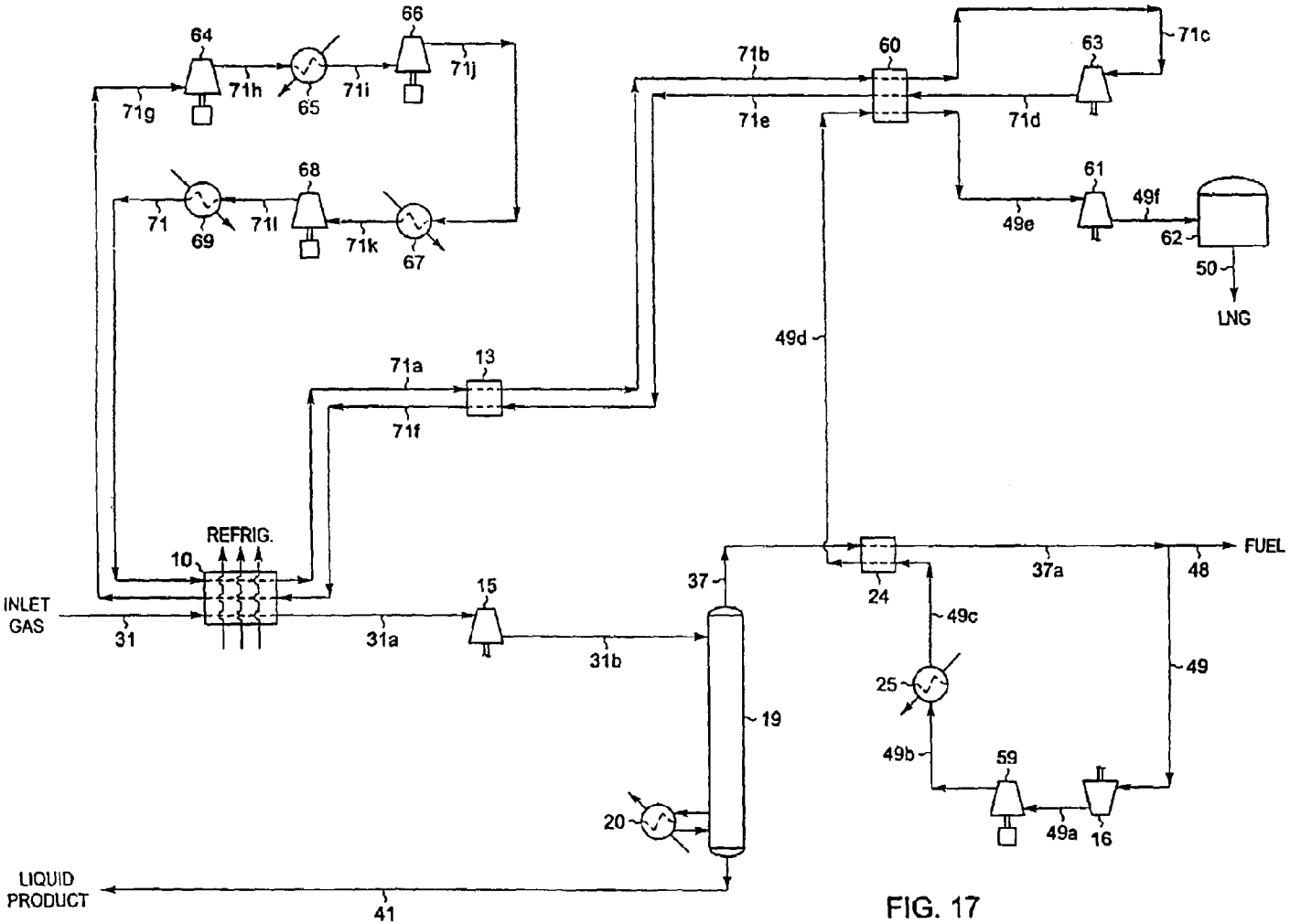
FIG. 17 is a flow diagram of an alternative natural gas liquefaction plant adapted for co-production of a liquid stream in accordance with the present invention.
Figure 18:
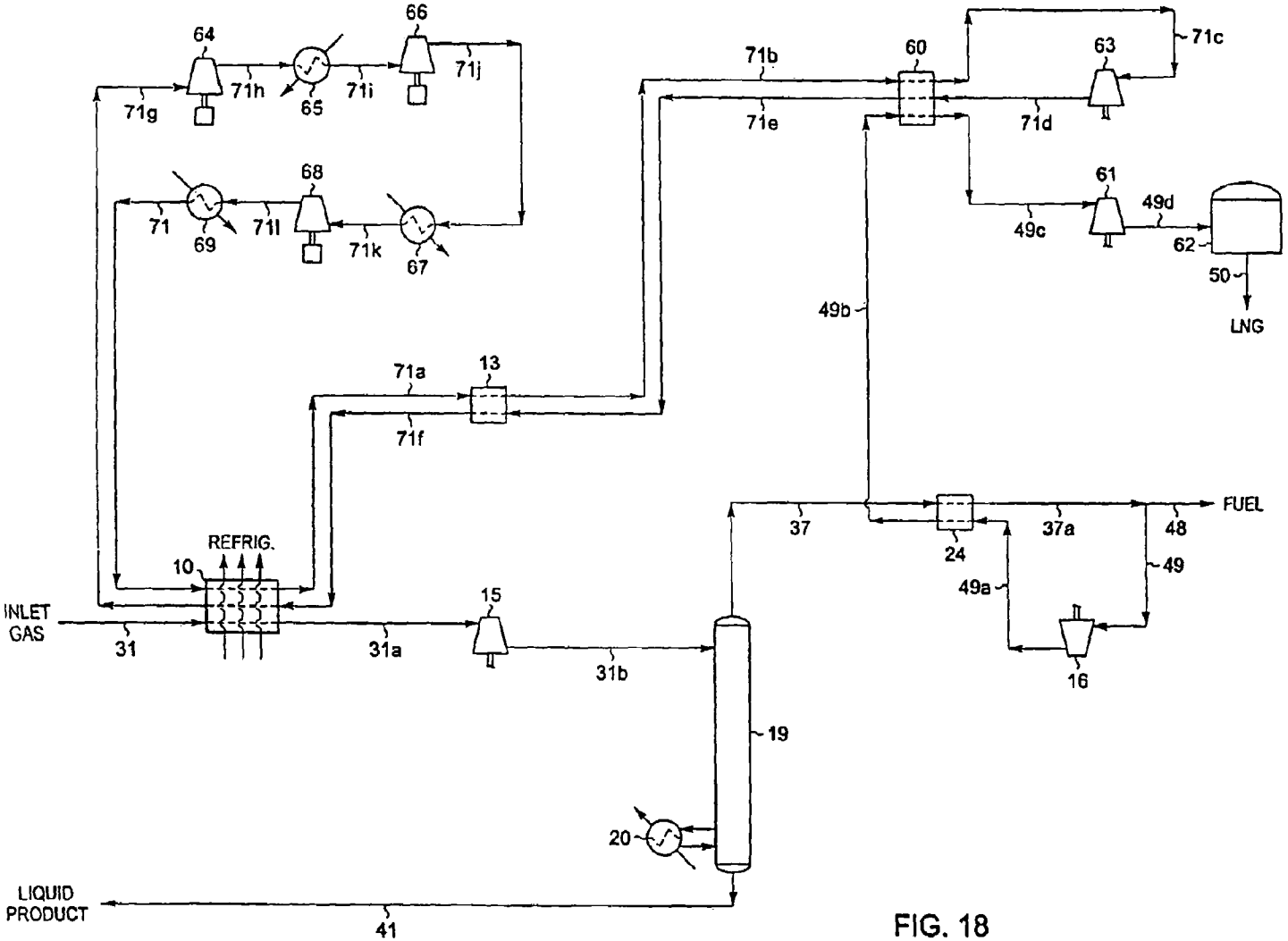
FIG. 18 is a flow diagram of an alternative natural gas liquefaction plant adapted for co-production of a liquid stream in accordance with the present invention.
Figure 19:
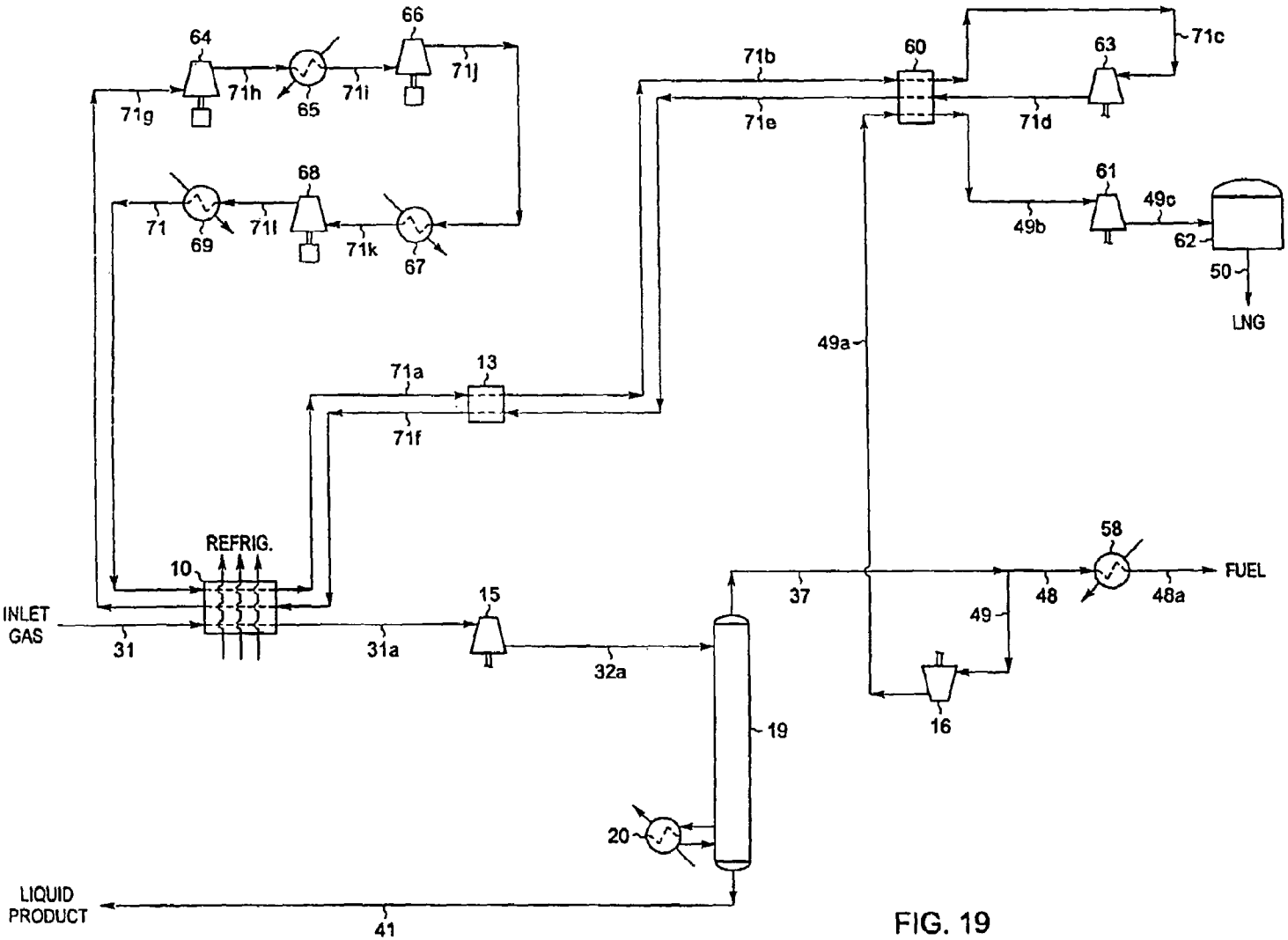
FIG. 19 is a flow diagram of an alternative natural gas liquefaction plant adapted for co-production of a liquid stream in accordance with the present invention.
Figure 20:
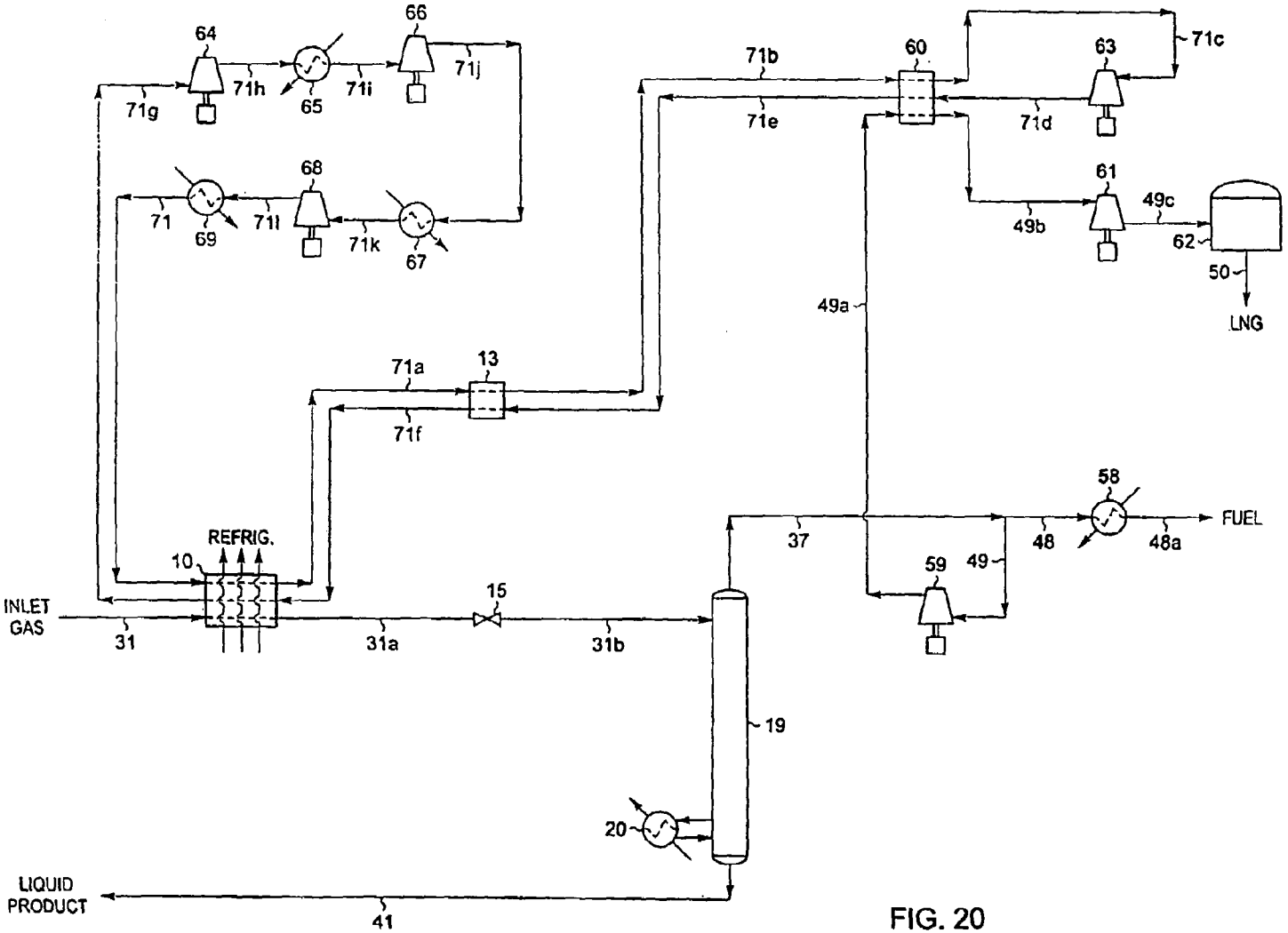
FIG. 20 is a flow diagram of an alternative natural gas liquefaction plant adapted for co-production of a liquid stream in accordance with the present invention.
Figure 21:
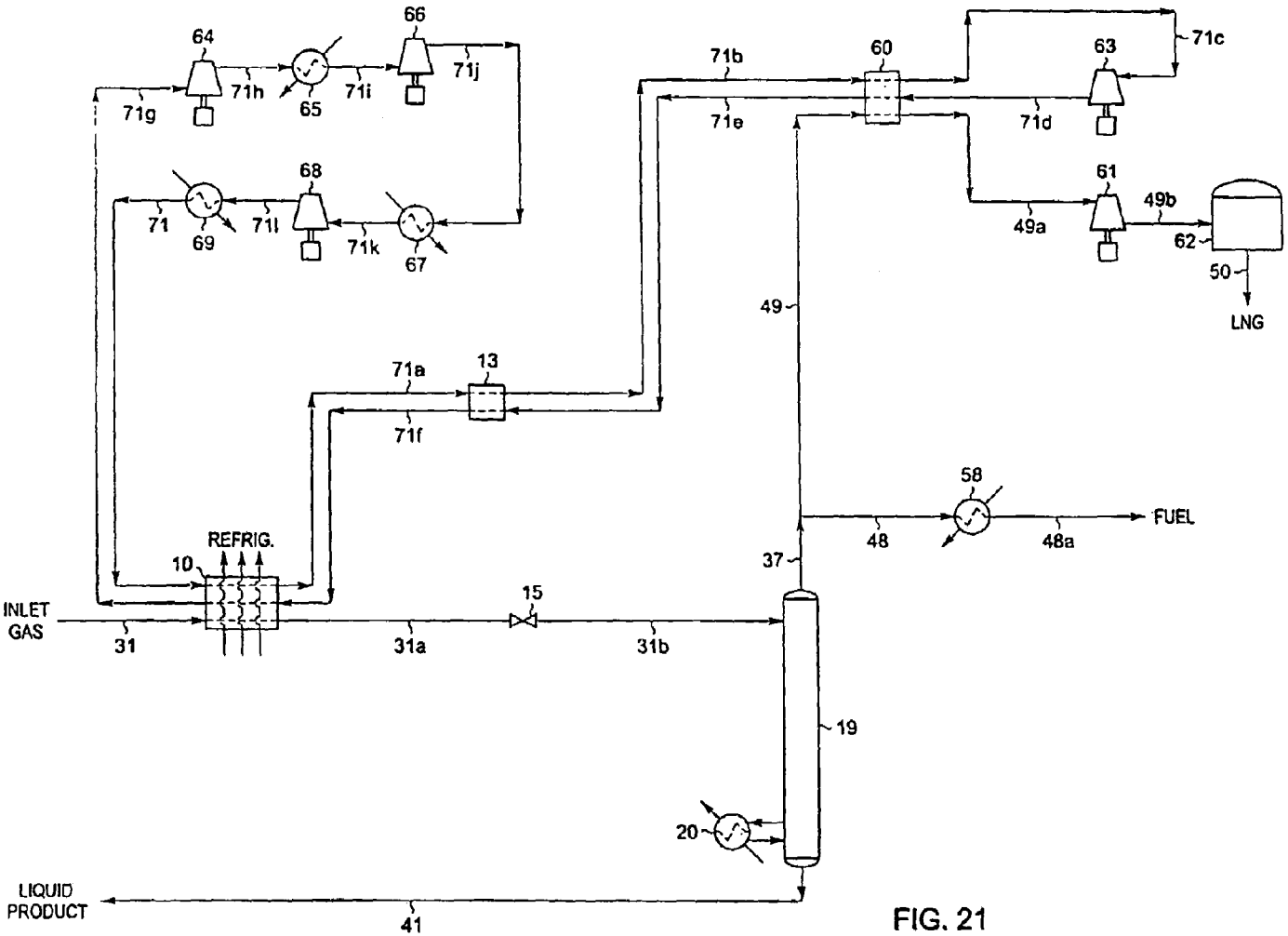
FIG. 21 is a flow diagram of an alternative natural gas liquefaction plant adapted for co-production of a liquid stream in accordance with the present invention.

The disposition of the gas stream remaining after recovery of the liquid co-product stream (stream 37 in FIGS. 1, 3, 6 through 11, 13, and 14, stream 47 in FIGS. 4, 12, 15, and 16, and stream 43 in FIG. 5) before it is supplied to heat exchanger 60 for condensing and subcooling may be accomplished in many ways. In the processes of FIGS. 1 and 3 through 16, the stream is heated, compressed to higher pressure using energy derived from one or more work expansion machines, partially cooled in a discharge cooler, then further cooled by cross exchange with the original stream. As shown in FIG. 17, some applications may favor compressing the stream to higher pressure, using supplemental compressor 59 driven by an external power source for example. As shown by the dashed equipment (heat exchanger 24 and discharge cooler 25) in FIGS. 1 and 3 through 16, some circumstances may favor reducing the capital cost of the facility by reducing or eliminating the pre-cooling of the compressed stream before it enters heat exchanger 60 (at the expense of increasing the cooling load on heat exchanger 60 and increasing the power consumption of refrigerant compressors 64, 66, and 68). In such cases, stream 49*a* leaving the compressor may flow directly to heat exchanger 24 as shown in FIG. 18, or flow directly to heat exchanger 60 as shown in FIG. 19. If work expansion machines are not used for expansion of any portions of the high pressure feed gas, a compressor driven by an external power source, such as compressor 59 shown in FIG. 20, may be used in lieu of compressor 16. Other circumstances may not justify any compression of the stream at all, so that the stream flows directly to heat exchanger 60 as shown in FIG. 21 and by the dashed equipment (heat exchanger 24, compressor 16, and discharge cooler 25) in FIGS. 1 and 3 through 16. If heat exchanger 24 is not included to heat the stream before the plant fuel gas (stream 48) is withdrawn, a supplemental heater 58 may be needed to warm the fuel gas before it is consumed, using a utility stream or another process stream to supply the necessary heat, as shown in FIGS. 19 through 21. Choices such as these must generally be evaluated for each application, as factors such as gas composition, plant size, desired co-product stream recovery level, and available equipment must all be considered.

In accordance with the present invention, the cooling of the inlet gas stream and the feed stream to the LNG production section may be accomplished in many ways. In the processes of FIGS. 1, 3, and 6 through 9, inlet gas stream 31 is cooled and condensed by external refrigerant streams and tower liquids from fractionation tower 19. In FIGS. 4, 5, and 10 through 14 flashed separator liquids are used for this purpose along with the external refrigerant streams. In FIGS. 15 and 16 tower liquids and flashed separator liquids are used for this purpose along with the external refrigerant streams. And in FIGS. 17 through 21, only external refrigerant streams are used to cool inlet gas stream 31. However, the cold process streams could also be used to supply some of the cooling to the high pressure refrigerant (stream 71*a*), such as shown in FIGS. 4, 5, 10, and 11. Further, any stream at a temperature colder than the stream(s) being cooled may be utilized. For instance, a side draw of vapor from separator/absorber tower 18 or fractionation tower 19 could be withdrawn and used for cooling. The use and distribution of tower liquids and/or vapors for process heat exchange, and the particular arrangement of heat exchangers for inlet gas and feed gas cooling, must be evaluated for each particular application, as well as the choice of process streams for specific heat exchange services. The selection of a source of cooling will depend on a number of factors including, but not limited to, feed gas composition and conditions, plant size, heat exchanger size, potential cooling source temperature, etc. One skilled in the art will also recognize that any combination of the above cooling sources or methods of cooling may be employed in combination to achieve the desired feed stream temperature(s).

Further, the supplemental external refrigeration that is supplied to the inlet gas stream and the feed stream to the LNG production section may also be accomplished in many different ways. In FIGS. 1 and 3 through 21, boiling single-component refrigerant has been assumed for the high level external refrigeration and vaporizing multi-component refrigerant has been assumed for the low level external refrigeration, with the single-component refrigerant used to pre-cool the multi-component refrigerant stream. Alternatively, both the high level cooling and the low level cooling could be accomplished using single-component refrigerants with successively lower boiling points (i.e., "cascade refrigeration"), or one single-component refrigerant at successively lower evaporation pressures. As another alternative, both the high level cooling and the low level cooling could be accomplished using multi-component refrigerant streams with their respective compositions adjusted to provide the necessary cooling temperatures. The selection of the method for providing external refrigeration will depend on a number of factors including, but not limited to, feed gas composition and conditions, plant size, compressor driver size, heat exchanger size, ambient heat sink temperature, etc. One skilled in the art will also recognize that any combination of the methods for providing external refrigeration described above may be employed in combination to achieve the desired feed stream temperature(s).

Subcooling of the condensed liquid stream leaving heat exchanger 60 (stream 49 in FIGS. 1, 6, and 8, stream 49*d* in FIGS. 3, 4, 7, and 9 through 16, stream 49*b* in FIGS. 5, 19, and 20, stream 49*e* in FIG. 17, stream 49*c* in FIG. 18, and stream 49*a* in FIG. 21) reduces or eliminates the quantity of flash vapor that may be generated during expansion of the stream to the operating pressure of LNG storage tank 62. This generally reduces the specific power consumption for producing the LNG by eliminating the need for flash gas compression. However, some circumstances may favor reducing the capital cost of the facility by reducing the size of heat exchanger 60 and using flash gas compression or other means to dispose of any flash gas that may be generated.

Although individual stream expansion is depicted in particular expansion devices, alternative expansion means may be employed where appropriate. For example, conditions may warrant work expansion of the substantially condensed feed stream (stream 35*a* in FIGS. 1, 3, 6, and 7) or the intermediate pressure reflux stream (stream 39 in FIGS. 1, 6, and 8). Further, isenthalpic flash expansion may be used in lieu of work expansion for the subcooled liquid stream leaving heat exchanger 60 (stream 49 in FIGS. 1, 6, and 8, stream 49*d* in FIGS. 3, 4, 7, and 9 through 16, stream 49*b* in FIGS. 5, 19, and 20, stream 49*e* in FIG. 17, stream 49*c* in FIG. 18, and stream 49*a* in FIG. 21), but will necessitate either more subcooling in heat exchanger 60 to avoid forming flash vapor in the expansion, or else adding flash vapor compression or other means for disposing of the flash vapor that results. Similarly, isenthalpic flash expansion may be used in lieu of work expansion for the subcooled high pressure refrigerant stream leaving heat exchanger 60 (stream 71*c* in FIGS. 1 and 3 through 21), with the resultant increase in the power consumption for compression of the refrigerant.

While there have been described what are believed to be preferred embodiments of the invention, those skilled in the art will recognize that other and further modifications may be made thereto, e.g. to adapt the invention to various conditions, types of feed, or other requirements without departing from the spirit of the present invention as defined by the following claims.

We claim:

1. In a process for liquefying a natural gas stream containing methane and heavier hydrocarbon components wherein (a) said natural gas stream is cooled under pressure to condense at least a portion of it and form a condensed stream; and (b) said condensed stream is expanded to lower pressure to form said liquefied natural gas stream;

the improvement wherein (1) said natural gas stream is treated in one or more cooling steps;

(2) said cooled natural gas stream is expanded to an intermediate pressure and thereafter directed into a contacting device, thereby forming a volatile residue gas fraction containing a major portion of said methane and lighter components and a first liquid stream;

(3) said first liquid stream is directed into a distillation column wherein said stream is separated into a more volatile vapor distillation stream and a relatively less volatile fraction containing a major portion of said heavier hydrocarbon components;

(4) said more volatile vapor distillation stream is cooled sufficiently to condense at least a part of it, thereby forming a second liquid stream;

(5) at least a portion of said expanded cooled natural gas stream is intimately contacted with at least part of said second liquid stream in said contacting device; and (6) said volatile residue gas fraction is cooled under pressure to condense at least a portion of it and form thereby said condensed stream.

2. In a process for liquefying a natural gas stream containing methane and heavier hydrocarbon components wherein (a) said natural gas stream is cooled under pressure to condense at least a portion of it and form a condensed stream; and (b) said condensed stream is expanded to lower pressure to form said liquefied natural gas stream;

the improvement wherein (1) said natural gas stream is treated in one or more cooling steps to partially condense it;

(2) said partially condensed natural gas stream is separated to provide thereby a vapor stream and a first liquid stream;

(3) said vapor stream is expanded to an intermediate pressure and thereafter directed into a contacting device, thereby forming a volatile residue gas fraction containing a major portion of said methane and lighter components and a second liquid stream;

(4) said first liquid stream is expanded to said intermediate pressure;

(5) said second liquid stream and said expanded first liquid stream are directed into a distillation column wherein said streams are separated into a more volatile vapor distillation stream and a relatively less volatile fraction containing a major portion of said heavier hydrocarbon components;

(6) said more volatile vapor distillation stream is cooled sufficiently to condense at least a part of it, thereby forming a third liquid stream;

(7) at least a portion of said expanded vapor stream is intimately contacted with at least part of said third liquid stream in said contacting device; and (8) said volatile residue gas fraction is cooled under pressure to condense at least a portion of it and form thereby said condensed stream.

3. In a process for liquefying a natural gas stream containing methane and heavier hydrocarbon components wherein (a) said natural gas stream is cooled under pressure to condense at least a portion of it and form a condensed stream; and (b) said condensed stream is expanded to lower pressure to form said liquefied natural gas stream;

the improvement wherein (1) said natural gas stream is treated in one or more cooling steps;

(2) said cooled natural gas stream is expanded to an intermediate pressure and thereafter directed into a contacting device, thereby forming a first vapor stream and a first liquid stream;

(3) said first liquid stream is directed into a distillation column wherein said stream is separated into a more volatile vapor distillation stream and a relatively less volatile fraction containing a major portion of said heavier hydrocarbon components;

(4) said more volatile vapor distillation stream is cooled sufficiently to condense at least a part of it, thereby forming a second vapor stream and a second liquid stream;

(5) a portion of said second liquid stream is directed into said distillation column as a top feed thereto;

(6) at least a portion of said expanded cooled natural gas stream is intimately contacted with at least part of the remaining portion of said second liquid stream in said contacting device;

(7) said first vapor stream is combined with said second vapor stream to form a volatile residue gas fraction containing a major portion of said methane and lighter components; and (8) said volatile residue gas fraction is cooled under pressure to condense at least a portion of it and form thereby said condensed stream.

4. In a process for liquefying a natural gas stream containing methane and heavier hydrocarbon components wherein (a) said natural gas stream is cooled under pressure to condense at least a portion of it and form a condensed stream; and (b) said condensed stream is expanded to lower pressure to form said liquefied natural gas stream;

the improvement wherein (1) said natural gas stream is treated in one or more cooling steps to partially condense it;

(2) said partially condensed natural gas stream is separated to provide thereby a first vapor stream and a first liquid stream;

(3) said first vapor stream is expanded to an intermediate pressure and thereafter directed into a contacting device, thereby forming a second vapor stream and a second liquid stream;

(4) said first liquid stream is expanded to said intermediate pressure;

(5) said second liquid stream and said expanded first liquid stream are directed into a distillation column wherein said streams are separated into a more volatile vapor distillation stream and a relatively less volatile fraction containing a major portion of said heavier hydrocarbon components;

(6) said more volatile vapor distillation stream is cooled sufficiently to condense at least a part of it, thereby forming a third vapor stream and a third liquid stream;

(7) a portion of said third liquid stream is directed into said distillation column as a top feed thereto;

(8) at least a portion of said expanded first vapor stream is intimately contacted with at least part of the remaining portion of said third liquid stream in said contacting device;

(9) said second vapor stream is combined with said third vapor stream to form a volatile residue gas fraction containing a major portion of said methane and lighter components; and

(10) said volatile residue gas fraction is cooled under pressure to condense at least a portion of it and form thereby said condensed stream.

5. The improvement according to claim 1, 2, 3 or 4 wherein said volatile residue gas fraction is compressed and thereafter cooled under pressure to condense at least a portion of it and form thereby said condensed stream.

6. The improvement according to claim 1, 2, 3 or 4 wherein said volatile residue gas fraction is heated, compressed, and thereafter cooled under pressure to condense at least a portion of it and form thereby said condensed stream.

7. The improvement according to claim 1, 2, or 3 wherein said volatile residue gas fraction contains a major portion of said methane, lighter components, and $C_2$ components.

8. The improvement according to claim 1, 2, or 3 wherein said volatile residue gas fraction contains a major portion of said methane, lighter components, $C_2$ components, and $C_3$ components.

9. The improvement according to claim 5 wherein said volatile residue gas fraction contains a major portion of said methane, lighter components, and $C_2$ components.

10. The improvement according to claim 6 wherein said volatile residue gas fraction contains a major portion of said methane, lighter components, and $C_2$ components.

11. The improvement according to claim 5 wherein said volatile residue gas fraction contains a major portion of said methane, lighter components, $C_2$ components, and $C_3$ components.

12. The improvement according to claim 6 wherein said volatile residue gas fraction contains a major portion of said methane, lighter components, $C_2$ components, and $C_3$ components.

* * * * *